US011763654B2

(12) United States Patent
Pozzini

(10) Patent No.: US 11,763,654 B2
(45) Date of Patent: Sep. 19, 2023

(54) MONITORING AND SIGNALING SYSTEM AND RELATED METHOD TO PREVENT THE ABANDONMENT OF INFANTS AND/OR PETS IN VEHICLES

(71) Applicant: Aubergine Factory S.r.l., Treviglio (IT)

(72) Inventor: Oscar Pozzini, Treviglio (IT)

(73) Assignee: Aubergine Factory S.r.l., Treviglio (IT)

( * ) Notice: Subject to any disclaimer, the term of this patent is extended or adjusted under 35 U.S.C. 154(b) by 30 days.

(21) Appl. No.: 17/604,487

(22) PCT Filed: Apr. 20, 2020

(86) PCT No.: PCT/IB2020/053730

§ 371 (c)(1),
(2) Date: Oct. 18, 2021

(87) PCT Pub. No.: WO2020/212960

PCT Pub. Date: Oct. 22, 2020

(65) Prior Publication Data

US 2022/0215734 A1 Jul. 7, 2022

(30) Foreign Application Priority Data

Apr. 18, 2019 (IT) ..... 102019000006092

(51) Int. Cl.
*G08B 21/02* (2006.01)
*G08B 21/22* (2006.01)

(52) U.S. Cl.
CPC ..... *G08B 21/0269* (2013.01); *G08B 21/0225* (2013.01); *G08B 21/0241* (2013.01);
(Continued)

(58) Field of Classification Search
CPC ..... G08B 21/0269; G08B 21/0225; G08B 21/0241; G08B 21/0266; G08B 21/0288;
(Continued)

(56) References Cited

U.S. PATENT DOCUMENTS 7,230,530 B1 * 6/2007 Almquist ..... B60N 2/28 340/665
8,816,845 B2 * 8/2014 Hoover ..... B60N 2/26 340/539.11

(Continued)

FOREIGN PATENT DOCUMENTS

EP 3312047 A1 4/2018
EP 3446917 A1 2/2019

OTHER PUBLICATIONS

PCT International Search Report and Written Opinion dated Sep. 7, 2020 for PCT/IB2020/053730.

*Primary Examiner* — An T Nguyen
(74) *Attorney, Agent, or Firm* — McCarter & English, LLP

(57) ABSTRACT

A monitoring and signaling system is provided that may include at least one safety device for a vehicle which can be coupled to a seat for infants or to an item for the boot for pets or to a pet collar, configured to generate an output signal indicative of the presence of an infant or a pet on the seat or in the boot or of the fact that the pet wears the collar. The system may further include a first signaling device configured to emit first signals in sequence when the output signal indicates the presence of the infant or of the pet in the vehicle; and a second signaling device configured to emit second signals in sequence when coupled to the vehicle. The system may further include a mobile device configured to: receive pairs of signals each formed by a first and a second signal, make determinations based thereon, and generate, based on the detection, different monitoring signals.

23 Claims, 14 Drawing Sheets

(52) U.S. Cl.
CPC ..... *G08B 21/0266* (2013.01); *G08B 21/0288* (2013.01); *G08B 21/22* (2013.01)

(58) Field of Classification Search
CPC ..... G08B 21/22; G08B 21/0252; G08B 21/0216; G08B 21/24; G08B 21/0205; H04L 67/10; H04W 4/008; H04W 8/22
See application file for complete search history.

(56) References Cited

U.S. PATENT DOCUMENTS

| | | | | |
|---|---|---|---|---|
| 9,173,087 | B2 * | 10/2015 | Pallotta | G08B 21/0202 |
| 9,393,897 | B2 * | 7/2016 | Gomez-Collazo | B60N 2/002 |
| 9,845,050 | B1 * | 12/2017 | Garza | G08B 21/0205 |
| 9,847,004 | B1 * | 12/2017 | Lan | G08B 21/24 |
| 10,137,887 | B2 * | 11/2018 | Upadhyay | B60W 30/025 |
| 10,163,316 | B2 * | 12/2018 | Roisen | B60N 2/2821 |
| 10,276,016 | B2 * | 4/2019 | Mattarocci | B60N 2/2821 |
| 2007/0273524 | A1 * | 11/2007 | Lee | G08B 21/22 340/572.1 |
| 2015/0130604 | A1 * | 5/2015 | Gomez Collazo | G08B 21/0205 340/457 |
| 2016/0379459 | A1 * | 12/2016 | Trang | G08B 25/08 340/457 |
| 2018/0068544 | A1 | 3/2018 | Caperell | |
| 2022/0215734 | A1 * | 7/2022 | Pozzini | G08B 21/24 |

* cited by examiner

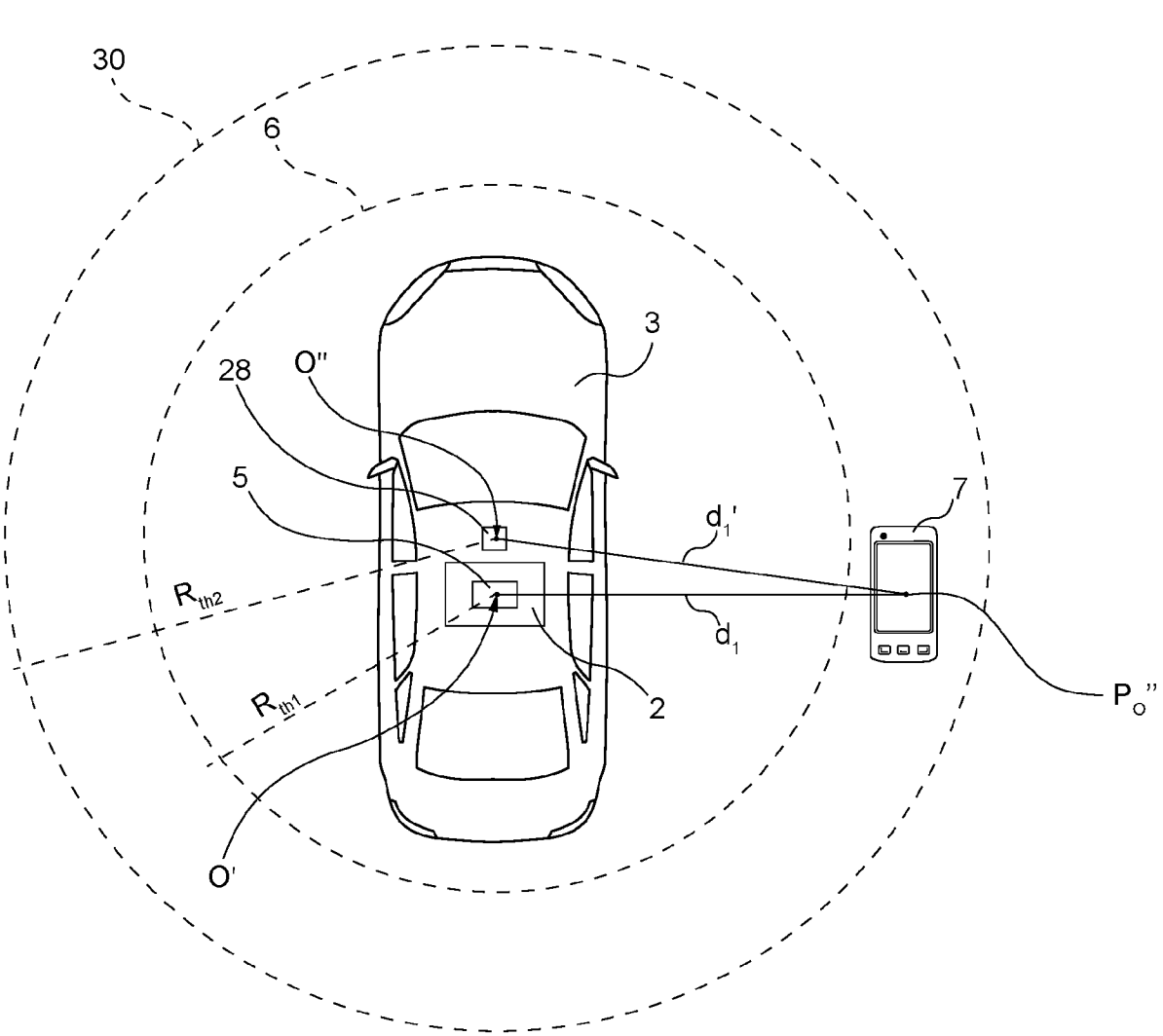
FIG. 5A
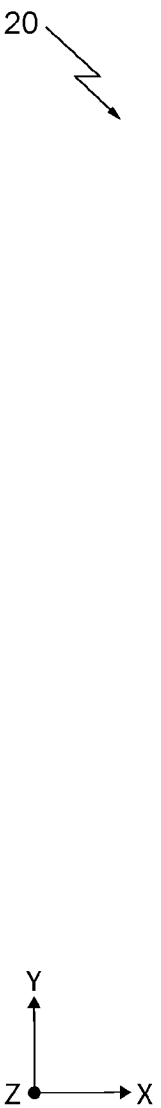

MONITORING AND SIGNALING SYSTEM AND RELATED METHOD TO PREVENT THE ABANDONMENT OF INFANTS AND/OR PETS IN VEHICLES

CROSS-REFERENCE TO RELATED APPLICATIONS

This Patent Application is a 35 U.S.C. § 371 National Stage filing of International Application No. PCT/IB2020/053730, filed on Apr. 20, 2020, which Application claims priority from Italian Patent Application No. 102019000006092 filed on Apr. 18, 2019, the entire disclosures of which are is incorporated herein by reference.

TECHNICAL FIELD

The present invention relates to a monitoring and signaling system and to a method to prevent the abandonment of infants and/or pets in vehicles thereof.

BACKGROUND ART

As is known, in recent years, the number of cases of abandonment of infants and/or pets, such as dogs, in closed vehicles and in adverse conditions (for example, in conditions of extreme heat) by parents or by pet caretakers (for example, dogsitters or catsitters) has increased; in particular, such situations of abandonment can compromise the physical and/or mental health of the infant and/or pet, since the latter are exposed to potentially deadly events.

Therefore, monitoring and signaling systems and methods adapted for preventing such events of abandonment events have been developed.

An example of a known monitoring and signaling system to prevent the abandonment of infants in vehicles is shown in FIGS. 1A-1B.

With joint reference to FIGS. 1A and 1B, the system, indicated with reference numeral 1, comprises a child seat 2, which may be housed in a vehicle 3 (for example, a car); in particular, the child seat 2 can be reversibly coupled with a seat (for example, rear) of the vehicle 3.

The child seat 2 is coupled to a detection and signaling device for a seat 5 (defined hereinafter as device 5), housed in an additional pad, which may be releasably coupled with the bottom part of the child seat 2 (for example, through velcro). Alternatively, the device 5 is integrated in the bottom part of the child seat 2.

FIG. 2 schematically shows the device 5, comprising a pressure detection unit 10, defined hereinafter as pressure sensor 10, and a first beacon 11, coupled to the pressure sensor 10 through suitable electric connection elements (for example electric cables, not shown). The pressure sensor 10 is powered through a battery (not shown), which can be rechargeable (for example, through solar energy) or non-rechargeable.

In particular, the pressure sensor 10 is configured to detect the presence of the infant on the child seat 2; in detail, when the infant is arranged on the child seat 2, the pressure sensor 10 detects the presence of the infant (for example, through capacitive detection) and generates a corresponding electric signal, which is transmitted to the first beacon 11.

The first beacon 11 is, in a first approximation, a point-like source, for example positioned in a first point O', configured to emit a first signal $S_1$, for example in radio frequency, using, for example, Bluetooth Low Energy technology, based on the aforementioned electric signal. In particular, the first signal $S_1$ is emitted by the first beacon 11 with a first periodicity $T_1$, comprised, for example, between 1 ms and 200 ms (for example 100 ms).

The system 1 further comprises a mobile device 7, for example a smartphone, a tablet or a notebook, schematically shown in FIG. 3. In particular, the mobile device 7 comprises: a receiver 13, for example a Bluetooth one, configured to receive the first signal $S_1$; an integrated logic 14, connected to the receiver 13; and a memory 15, connected to the integrated logic 14.

The integrated logic 14 is configured to process the first signal $S_1$ to generate a first processed datum; in particular, the first processed datum is a datum, obtained through known algorithms adapted to convert the first signal $S_1$ into a corresponding distance between the mobile device 7 and the first beacon 11 (i.e. the device 5).

The integrated logic 14 is further configured to verify, based on the distance obtained from the first signal $S_1$, that the mobile device 7 is positioned in a first signaling region 6 (shown with a dashed line in FIGS. 1A-1B); in particular, the first signaling region 6 is a predetermined geometric space having, for example, a spherical shape with radius $R_{th1}$ (for example equal to five meters) and center coinciding with the first point O'. Furthermore, the first radius $R_{th1}$ represents a reference distance with respect to which the integrated logic 14 compares the corresponding distance. In particular, the system 1 is in a proximity condition when the corresponding distance of the mobile device 7 with respect to the device 5 is less than the first radius $R_{th1}$, i.e. it is in the first signaling region 6; furthermore, the system 20 is in a distance condition when the corresponding distance of the mobile device 7 with respect to the device 5 is greater than the first radius $R_{th1}$, i.e. when it is outside the first signaling region 6.

Furthermore, the integrated logic 14 is configured to generate a monitoring signal when it detects that the system 20 is in the distance condition.

Furthermore, the integrated logic 14 is configured to execute an application ("app"), installed in the mobile device 7, to generate a signaling notification as a function of the corresponding monitoring signal; in particular, the signaling notification is, for example, an SMS or an acoustic signal.

In addition, the integrated logic 14 of the mobile device 7 is configured to determine in a per se known way a GPS ("Global Positioning System") position of the mobile device 7 through a GPS receiver 16 (schematically shown in FIG. 3), the latter coupled to the integrated logic 14. In detail, the integrated logic 14 activates the GPS receiver 16 only when it detects that the system 20 is in the proximity condition.

In use, the system 1 operates according to a monitoring and signaling method described in detail hereinafter with reference to FIGS. 1A-1B.

In a first operative step, in particular at a first time instant to, FIG. 1A, the infant is arranged on the child seat 2 and, therefore, on the device 5; consequently, the pressure sensor 10 detects the presence of the infant, generates an electric signal and transmits it to the first beacon 11, which is activated and generates the first signal $S_1$.

At a second time instant $t_1$, defined as the sum between the first time instant to and a first time interval $\Delta t_{0,1}$ (i.e. the propagation time of the first signal $S_1$ from the device 5 to the mobile device 7 in the step of FIG. 1A), the receiver 13 receives the first signal $S_1$ and transmits it to the integrated logic 14; the integrated logic 14 processes the aforementioned first signal $S_1$ according to the previously described modalities to determine the first processed datum, i.e. a first distance (indicated hereinafter with do), present between the mobile device 7 and the device 5 at the second time instant $t_1$.

Thereafter, the integrated logic 14 carries out a verification through the app, in which it compares the first distance do with the radius $R_{th1}$ of the first signaling region 6 to determine whether the mobile device 7 is in the first signaling region 6. In the first operative step shown in FIG. 1A, the integrated logic 14 determines, through the app, that the first distance do is less than the radius $R_{th1}$ (proximity condition), i.e. the mobile device 7 is close to the device 5.

After the aforementioned verification, the integrated logic 14 activates the GPS receiver 16, which determines a first GPS position $P_0$ of the mobile device 7 at the second time instant $t_1$; thereafter, the integrated logic 14 receives the aforementioned first GPS position $P_0$ and memorizes it in the memory 15.

After verifying and determining the first GPS position $P_0$, in the first operative step, the integrated logic 14 generates a first signaling notification, for example showing the phrase "baby on board" on the mobile device 7 (for example, on the screen of the mobile device 7); in particular, the first signaling notification is adapted for warning the user of the mobile device 7 (for example, a parent or a babysitter) that the infant is on the child seat 2 and in the vehicle 3 and that the mobile device 7 is in the first signaling region 6.

In the second operative step, in particular at a third time instant $t_2$, after the second time instant $t_1$, FIG. 1B, the first beacon 11 is activated and once again emits the first signal $S_1$, since, in this step, the infant is still on the child seat 2.

Therefore, at a fourth time instant $t_3$, defined as the sum between the third time instant $t_2$ and a second time interval $\Delta t_{0,2}$ (i.e. the propagation time of the first signal $S_1$ from the device 5 to the mobile device 7 in the step of FIG. 1B), the receiver 13 receives the first signal $S_1$ and sends it to the integrated logic 14; in particular, the integrated logic 14 processes the aforementioned first signal $S_1$ to determine a second distance $d_1$, present between the mobile device 7 and the device 5 at the fourth time instant $t_3$.

The integrated logic 14 once again carries out the verification step through the app, in which it compares the second distance $d_1$ with the radius $R_{th1}$ of the first signaling region 6, i.e. whether the system 20 is in the proximity condition at the fourth time instant $t_3$. In particular, in the second operative step, the integrated logic 14 determines that the second distance $d_1$ is greater than the radius $R_{th1}$ (distance condition) and, therefore, the mobile device 7 is far from the device 5. In other words, the integrated logic 14 determines whether the infant on the child seat 2 has been abandoned in the vehicle 3. Consequently, the integrated logic 14 generates a first monitoring signal $S_{m0}$ indicative of the distance condition of the mobile device 7; based on the first monitoring signal $S_{m0}$, the integrated logic 14 generates, through the app, a second signaling notification on the mobile device 7, for example showing the phrase "baby on board", adapted for signaling the user of the abandonment in the vehicle 3 of the child seat 2 (and therefore of the infant).

The monitoring and signaling method described above memorizes the most recent GPS position associated with a respective distance from the device 5 only when the aforementioned positioning verification in the first signaling region 6 gives a positive outcome (i.e. the mobile device 7 is in the first signaling region 6).

Further examples of systems and of relative monitoring and signaling methods are described in US patent US 2018/0322758 A1.

Monitoring systems for infants and for pets in a vehicle are also known, like, for example, the monitoring and signaling system indicated in the article "Low-cost low-power in-vehicle occupant detection with mm-wave FMCW radar" by Alizadeh M. et al. (https://arxiv.org/pdf/1908.04417pdf).

However, the aforementioned systems and methods have drawbacks.

In particular, with reference to the system 1 of FIGS. 1A and 1B and to the relative method and as discussed earlier, the sending of the signaling notifications is subject to a verification of the position of the mobile device 7 in a predetermined spatial region (i.e. the first signaling region 6), centered in the first beacon 11 of the device 5.

However, in some cases, the verification operation by the integrated logic 14 can generate false alarms. For example, when the infant is arranged on the child seat 2, but it is not in the vehicle 3, and the mobile device 7 is outside the first signaling region 6, the integrated logic 14 of the mobile device 7 detects the distance condition and, therefore, generates a corresponding signaling notification; such a signaling notification represents a false alarm, since the infant has not been abandoned in the vehicle 3.

Similar considerations are also valid for monitoring and signaling systems for pets.

DISCLOSURE OF INVENTION

The purpose of the present invention is to provide a system and a method that at least partially overcome the drawbacks of the prior art.

According to the present invention a monitoring and signaling system and a relative method for preventing the abandonment of infants in vehicles are made, as defined in the attached claims.

BRIEF DESCRIPTION OF THE DRAWINGS

In order to provide a better understanding of the present invention preferred embodiments thereof will now be described, purely as a non-limiting example, with reference to the attached drawings, in which:

FIGS. 5A-5B schematically show views from above of the monitoring and signaling system of FIG. 4 in a first operative mode;

BEST MODE FOR CARRYING OUT THE INVENTION

Figure 4:
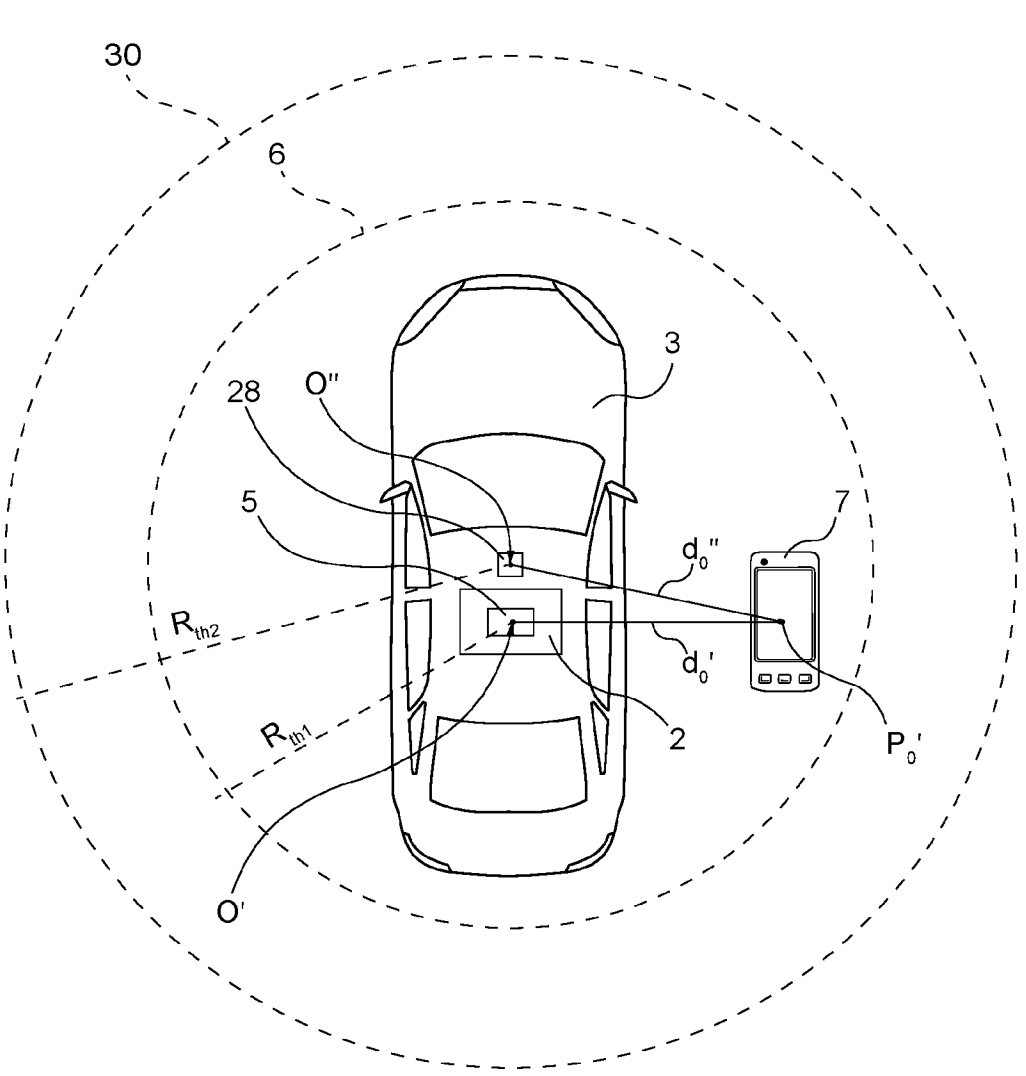
FIG. 4 schematically shows a view from above of the present monitoring and signaling system used for monitoring the presence of an infant in a vehicle.
Figure 4:
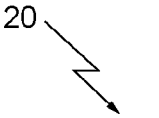
Figure 4:
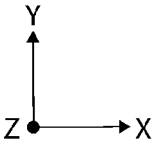

FIG. 4 schematically shows a monitoring and signaling system 20 (indicated hereinafter as system 20); in particular, the system 20 has a similar structure to the system 1 of FIGS. 1A-1B, 2-3 and, therefore, it will be described limited to the differences with respect to the aforementioned system 1.

In particular, the vehicle 3 is coupled to a second beacon 28, arranged, for example, on the dashboard of the vehicle 3. In greater detail, the second beacon 28 is, in a first approximation, a point-like source, for example positioned at a second point O", configured to emit, independently from the first beacon 11, a second signal $S_2$, for example in radio frequency, using, for example, Bluetooth Low Energy technology; in particular, the second signal $S_2$ is emitted with a second periodicity $T_2$, which, as a non-limiting example, is assumed to be equal to the first periodicity $T_1$ (i.e. comprised, for example, between 1 ms and 200 ms, for example 100 ms).

In further embodiments, the second periodicity $T_2$ is defined as the sum between the first periodicity $T_1$ and a delay $\Delta T$, for example equal to 1 ms; in this way, in use, the receiver 13 of the mobile device 7 receives the second signal $S_2$ with a delay equal to the delay $\Delta T$ with respect to the first signal $S_1$.

Assuming, for the sake of simplicity, that the first and the second beacon 11, 28 respectively emit the first and the second signal $S_1$, $S_2$ at the same time instant, the first and the second beacon 11, 28 emit the first and the second signal $S_1$, $S_2$ in an approximately spherical region (not shown and defined hereinafter as region of maximum reception), with radius equal, for example, to 70 meters. In greater detail, in the hypothetical case in which the first and the second signal $S_1$, $S_2$ propagate in free space, the receiver 13 of the mobile device 7 has a sensitivity such as to be capable of correctly receive (and thus process to determine the corresponding data) both the first and the second signal $S_1$, $S_2$, when inside the aforementioned region of maximum reception.

The integrated logic 14 is further configured to process the second signal $S_2$ to generate a second processed datum; in particular, the second processed datum is a datum obtained through known algorithms adapted to determine, from the second signal $S_2$, a corresponding distance between the mobile device 7 and the second beacon 28 from the second signal $S_2$.

The integrated logic 14 is further configured to verify, based on the distance obtained from the second signal $S_2$, that the mobile device 7 is positioned in a second signaling region 30 (shown with a dashed line in FIG. 4); in particular, the second signaling region 30 is a predetermined geometric space having, for example, a spherical shape with radius $R_{th2}$ (for example equal to twenty meters) and center coinciding with the second point O". Without any loss of generality, the radius $R_{th1}$ of the first signaling region 6 is less than the radius $R_{th2}$ of the second signaling region 30. In addition, the radii $R_{th1}$, $R_{th2}$ of the first and the second signaling region 6, 30 respectively are less with respect to the radius of the region of maximum reception.

In particular, the system 20 is in a proximity condition when the distances obtained from the first and second signals $S_1$, $S_2$ are less, respectively, than the first and second radius $R_{th1}$, $R_{th2}$, i.e. the mobile device 7 is both in the first and in the second signaling region 6, 30; furthermore, the system 20 is in a distance condition when the aforementioned distances are both greater than the first and the second radius $R_{th1}$, $R_{th2}$ respectively, i.e. the mobile device 7 is outside of both the first and the second signaling region 6, 30.

In addition, the system 20 is in a first intermediate condition when the distance obtained from the first signal $S_1$ is greater than the first radius $R_{th1}$ and the distance obtained from the second signal $S_2$ is less than the second radius $R_{th2}$, i.e. the mobile device 7 is outside the first signaling region 6 and inside the second signaling region 30; furthermore, the system 20 is in a second intermediate condition when the distance obtained from the first signal $S_1$ is less than the first radius $R_{th1}$ and the distance obtained from the second signal $S_2$ is greater than the second radius $R_{th2}$, i.e. the mobile device 7 is inside the first signaling region 6 and outside the second signaling region 30.

Furthermore, the integrated logic 14 is configured to generate respective monitoring signals when it detects that the mobile device 7 is in the first or in the second intermediate condition or in the distance condition.

Furthermore, the integrated logic 14 is configured to execute the app to generate a signaling notification as a function of the aforementioned monitoring signals; in particular, the signaling notification is, for example, an SMS or an acoustic signal generated by the mobile device 7.

Figure 2:
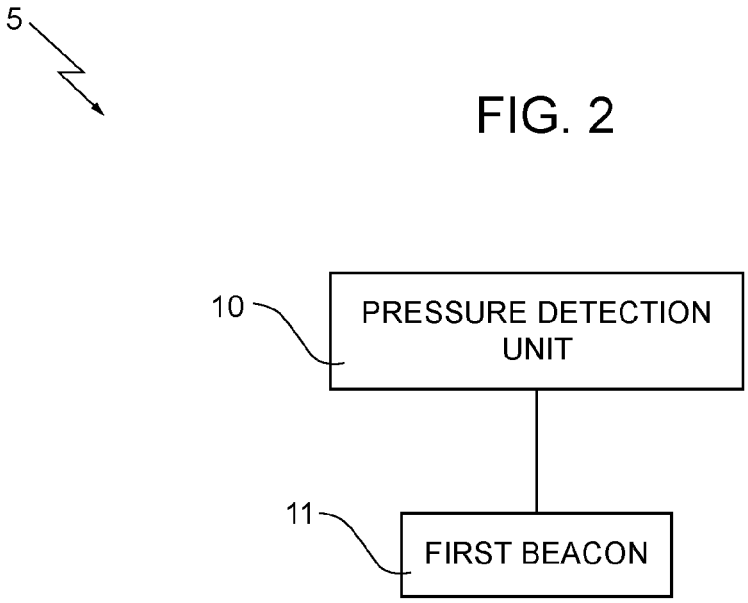
FIG. 2 schematically shows a signaling and detection device forming part of the monitoring and signaling system of FIGS. 1A-1B.
Figure 3:
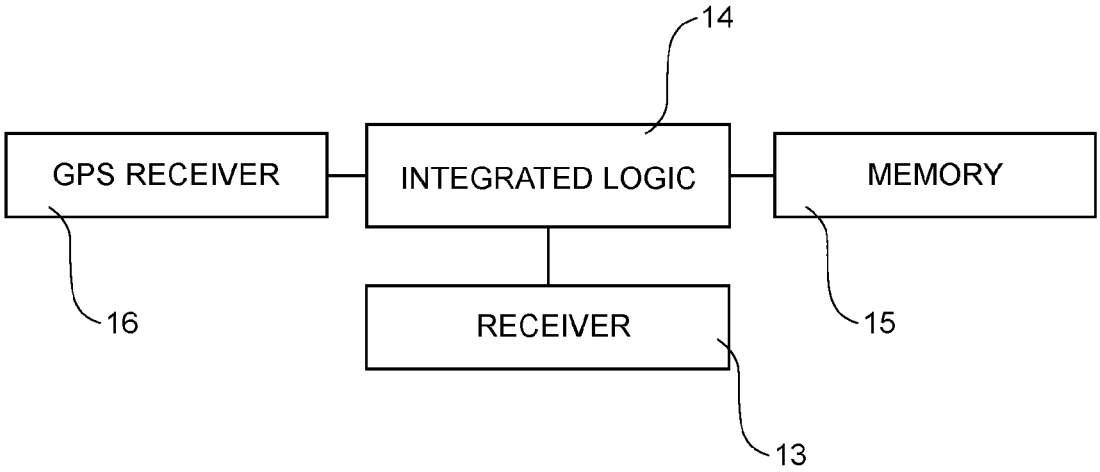
FIG. 3 schematically shows a mobile device forming part of the monitoring and signaling system of FIGS. 1A-1B.
Figure 8:
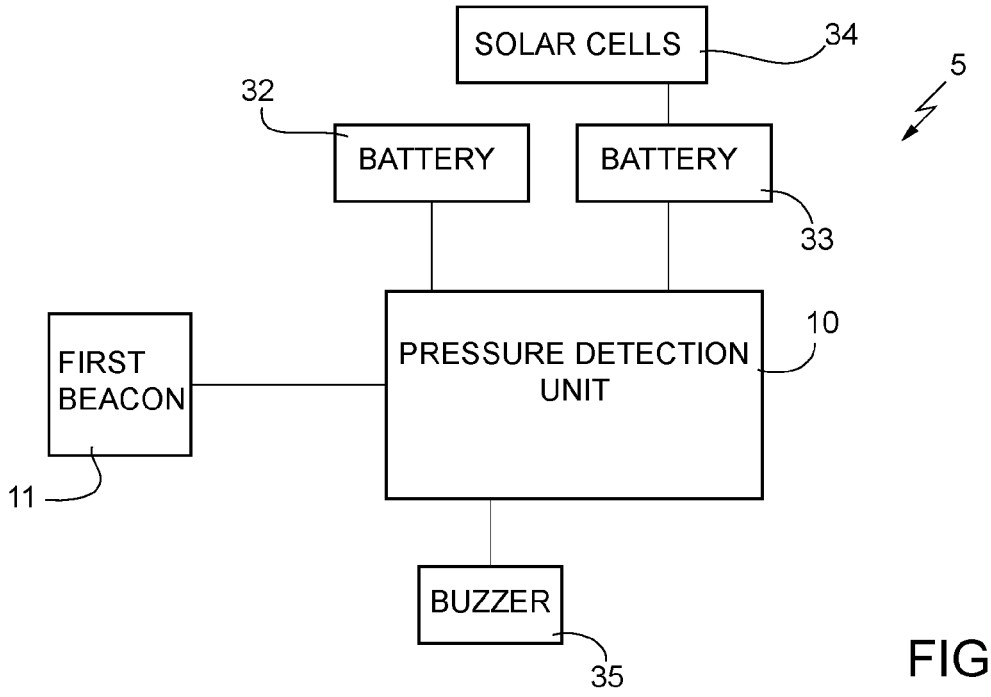
FIG. 8 schematically shows a signaling and detection device forming part of the monitoring and signaling system of FIGS. 4-7 used for monitoring the presence of an infant or of a pet in the vehicle.

In a further embodiment of the device 5, shown in FIG. 8 and alternative to the embodiment of FIG. 2, the aforementioned device 5 comprises, as well as the pressure sensor 10 and the first beacon 11 and a battery (indicated in FIG. 8 with reference numeral 32), a further battery 33, of the rechargeable type; in particular, the further battery 33 is connected to a solar cell 34, the latter being adapted for charging the further battery 33 through a conversion of solar energy into electric energy. In addition, the device 5 comprises a signaling element 35, for example a buzzer, adapted for generating a signal (for example a vibration or an acoustic signal) adapted for identifying various types of notifications, like, for example, a correct installation of the device 5, as well as of the app on the mobile device 7 (i.e. a correct installation of the set-up for the operation of the system 20), a correct seating or a correct detection of the infant and/or of the pet and anomalies in the operation of the device 5. The device 5 shown in FIG. 8 operates in an analogous manner to what is described with reference to the device 5 of FIG. 2. Furthermore, the device 5 of FIG. 8 can be used both for the detection of the presence of an infant on a child seat 2 and for the detection of the presence of a pet in the vehicle 3; in the first case, the device 5 of FIG. 8 is arranged on the bottom part of the child seat 2 or it can be integrated into it and, in the second case, the device 5 of FIG. 8 is arranged, for example, on the surface of the bed of the boot of the vehicle 3 or on the surface of a base of a pet carrier adapted for containing the pet to be transported.

In use, the system 20 operates according to a monitoring and signaling method described in detail hereinafter. In particular, three operating modes are described hereinafter, alternative to one another. In particular, hereinafter and without any loss of generality, reference is made to a monitoring and signaling method for monitoring whether or not an infant is present on the child seat 2. In addition, for the sake of simplicity of description, hereinafter reference is made to a device of the type shown in FIG. 2; similar considerations extend to the devices of the type shown in FIG. 8.

Hereinafter, it is assumed, without any loss of generality, that the system 20 of FIG. 4 represents a first operative step (in particular, in a first time instant $t_0'$) common to the three operative modes described hereinafter.

Figure 1A:
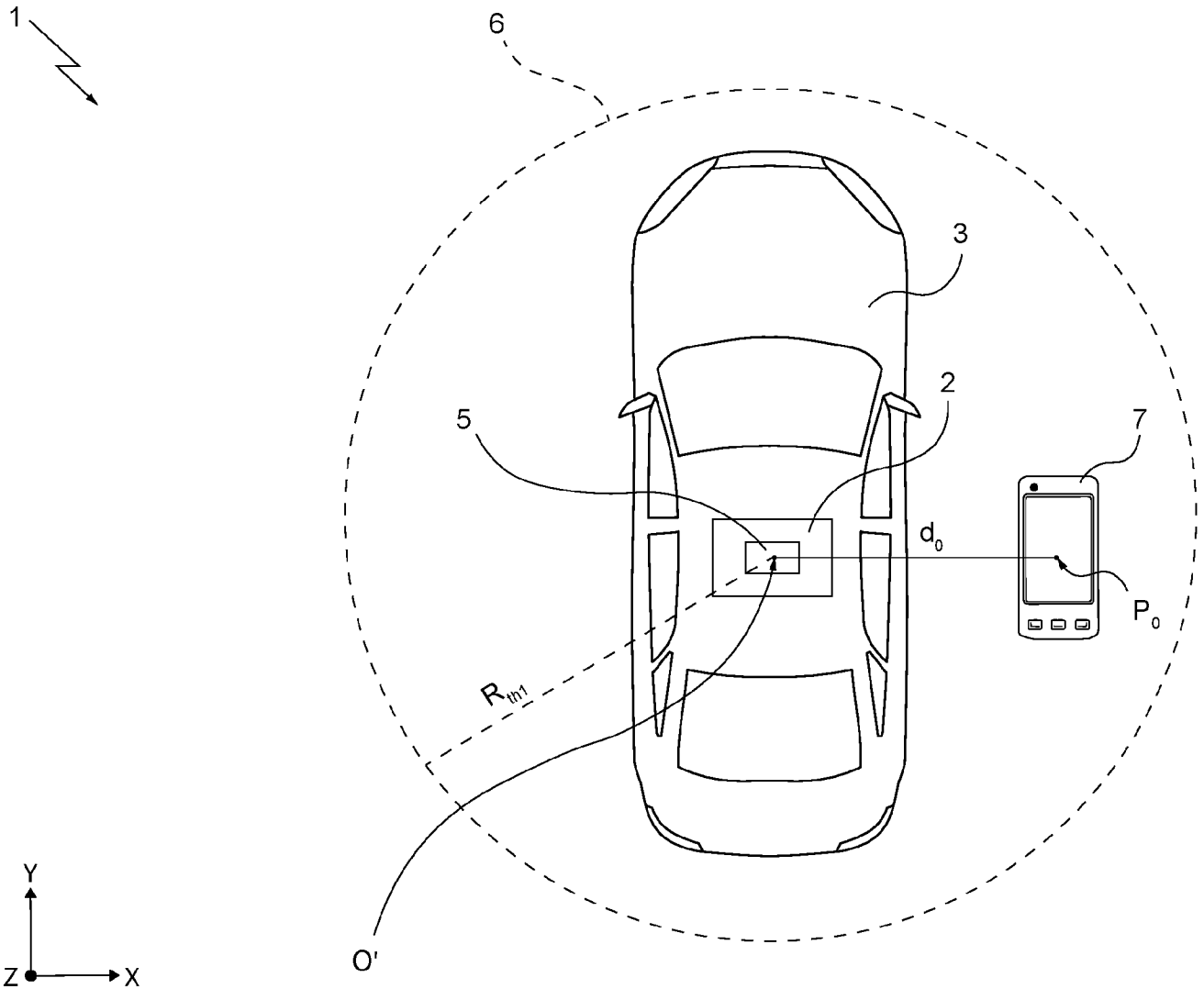
FIGS. 1A-1B schematically show views from above of a known monitoring and signaling system in a first and a second operative step, respectively.
Figure 1B:
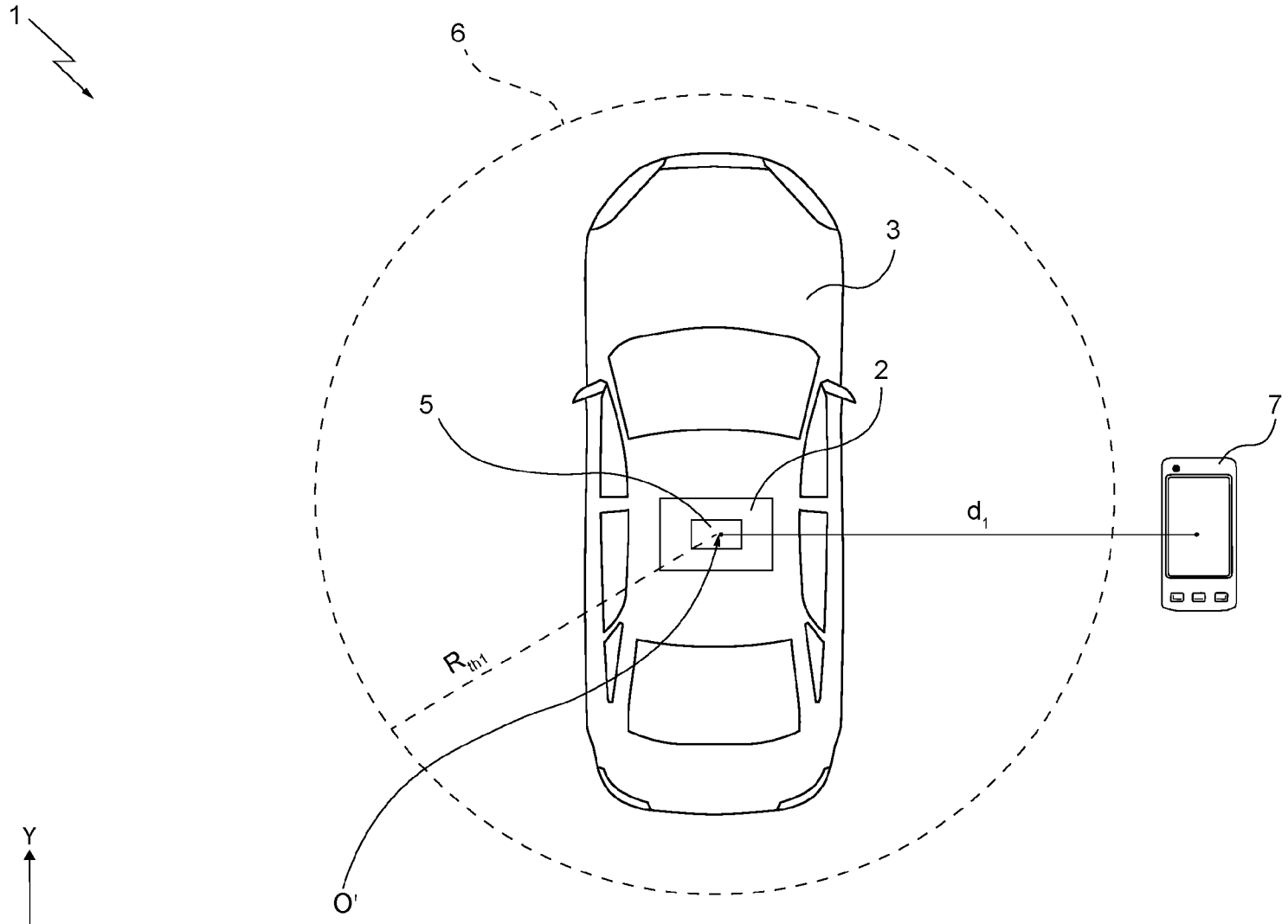

In greater detail, the operative step shown in FIG. 4 is analogous to the first operative step described with reference to FIG. 1A.

In a first time instant $t_0'$, the infant is arranged on the child seat 2 and, therefore, on the device 5; consequently, the pressure sensor 10 detects the presence of the infant, generates an electric signal and transmits it to the first beacon 11, which is activated and generates the first signal $S_1$.

At the first time instant $t_0'$, the second beacon 28 emits the second signal $S_2$ independently from the first beacon 11. For the sake of simplicity of description and without any loss of generality, it is assumed that the first and the second beacon 11, 28 emit the respective first and second signal $S_1$, $S_2$ in the same first time instant $t_0'$. Furthermore, it is assumed that the mobile device 7 receives the aforementioned first and second signal $S_1$, $S_2$ at the same time instant; in other words, hereinafter, for the sake of simplicity, the distance between first and second beacon 11, 28 will be ignored, except where specified otherwise.

At a second time instant $t_1'$, defined as the sum between the first time instant $t_0'$ and a first time interval $\Delta t_{0,1}'$, the receiver 13 receives the first signal $S_1$ and transmits it to the integrated logic 14; in detail, the integrated logic 14 processes the aforementioned first signal $S_1$ according to the previously described modalities to determine the first processed datum, i.e. a first distance $d_0'$ of the mobile device 7 with respect to the device 5 at the second time instant $t_1'$.

At the same second time instant $t_1'$, the receiver 13 further receives the second signal $S_2$ and transmits it to the integrated logic 14; in detail, the integrated logic 14 processes the aforementioned second signal $S_2$ according to the previously described modalities with reference to the first signal to determine the processed second datum, i.e. a second distance $d_0''$ of the mobile device 7 with respect to the second beacon 28 at the second time instant $t_1'$.

It should be noted that, since the receiver 13 receives both the first and the second signal $S_1$, $S_2$ at the second time instant $t_1'$, the first time interval $\Delta t_{0,1}'$ represents the propagation time of the first and second signals $S_1$, $S_2$ from the device 5 and from the second beacon 28 respectively to the receiver 13 in the step of FIG. 4.

The first and the second signals $S_1$, $S_2$ received at the second time instant $t_1'$ form a first pair of signals.

Thereafter, the integrated logic 14 carries out a first verification through the app, in which it compares the first distance $d_0'$ with the radius $R_{th1}$ of the first signaling region 6 to determine whether the mobile device 7 is in the first signaling region 6. In the operative step of FIG. 4, the integrated logic 14 determines, through the app, that the first distance $d_0'$ is less than the radius $R_{th1}$ and, therefore, that the mobile device 7 is close to the device 5.

At the same second time instant $t_1'$, the integrated logic 14 carries out a second verification through the app, in which it compares the second distance $d_0''$ with the radius $R_{th2}$ of the second signaling region 30 to determine whether the mobile device 7 is in the second signaling region 30. In the step shown in FIG. 4, the integrated logic 14 determines that the second distance $d_0''$ is less than the radius $R_{th2}$, i.e. that the mobile device 7 is close to the second beacon 28 (and, therefore, to the vehicle 3).

Therefore, since both the verification of the first distance $d_0'$ with respect to the radius $R_{th1}$ and the verification of the second distance $d_0''$ with respect to the radius $R_{th2}$ have given a positive outcome, i.e. the system 20 is in the proximity condition, the integrated logic 14 activates the GPS receiver 16, which determines a first GPS position $P_0'$ of the mobile device 7 at the second time instant $t_1'$. Thereafter, the first GPS position $P_0'$, which is associated to the first and the second distance $d_0'$, $d_0''$, is received by the integrated logic 14 and is memorized in the memory 15.

Furthermore, in the operative step described above, the integrated logic 14 executes the app to generate a first signaling notification, for example a text notification showing the phrase "baby on board" on the mobile device 7 (for example, on the screen); such a signaling notification makes it possible to warn the user of the mobile device 7 that the infant is on board the vehicle 3.

Figure 5B:
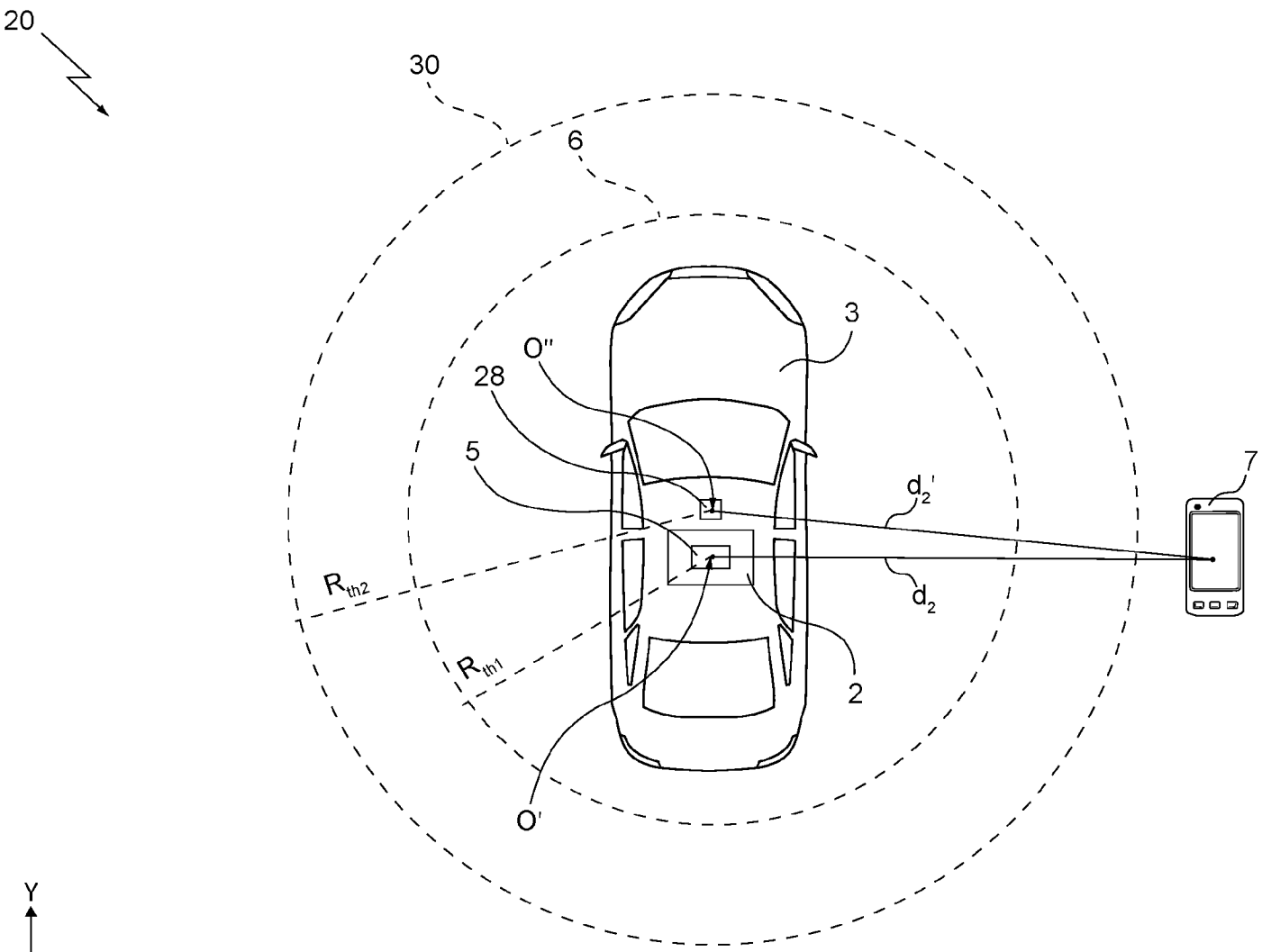

FIGS. 5A-5B show successive steps of a first operative mode, which follow the step shown in FIG. 4. In greater detail, each of the steps shown in FIGS. 5A-5B carries out the same operations described with reference to FIG. 4.

In particular, FIG. 5A, at a third time instant $t_2'$, after the second time instant $t_1'$, the infant is still arranged on the child seat 2 and, therefore, on the device 5; consequently, also in this step, the first beacon 11 emits the first signal $S_1$. At the same third time instant $t_2'$, the second beacon 28 once again emits the second signal $S_2$.

At a fourth time instant $t_3'$, defined as the sum between the third time instant $t_2'$ and a second time interval $\Delta t_{0,2}'$, the receiver 13 receives the first signal $S_1$ and transmits it to the integrated logic 14; the integrated logic 14 processes the aforementioned first signal $S_1$ according to the previously described modalities to once again determine the first processed datum, i.e. a third distance $d_1$ of the mobile device 7 with respect to the device 5 at the fourth time instant $t_3'$.

At the same fourth time instant $t_3'$, the receiver 13 receives the second signal $S_2$ and transmits it to the integrated logic 14; in detail, the integrated logic 14 processes the aforementioned second signal $S_2$ according to the previously described modalities with reference to the first signal $S_1$ to once again determine the processed second datum, i.e. a fourth distance $d_1'$ of the mobile device 7 with respect to the second beacon 28 at the fourth time instant $t_3'$.

In particular, the first and the second signal $S_1$, $S_2$ received at the fourth time instant $t_3'$ form a second pair of signals.

Furthermore, similarly to what was discussed with reference to the first time interval $\Delta t_{0,1}'$, the second time interval $\Delta t_{0,2}'$ represents the propagation time of the first and of the second signal $S_1$, $S_2$ from the device 5 and from the second beacon 28 respectively to the receiver 13 in the step of FIG. 5A.

Thereafter, the integrated logic 14 once again carries out the first verification through the app, in which it compares the third distance $d_1$ with the radius $R_{th1}$ of the first signaling region 6 to determine whether the mobile device 7 is in the first signaling region 6. In the operative step of FIG. 5A, the integrated logic 14 determines that the third distance $d_1$ is greater than the radius $R_{th1}$ of the first signaling region 6, i.e. that the mobile device 7 is far from the device 5.

At the same fourth time instant $t_3'$, the integrated logic 14 further carries out the second verification through the app, in which it compares the fourth distance $d_1'$ with the radius $R_{th2}$ of the second signaling region 30 to determine whether the mobile device 7 is in the second signaling region 30. In the step shown in FIG. 5A, the integrated logic 14 determines that the fourth distance $d_1'$ is less than the radius $R_{th2}$ and, therefore, the mobile device 7 is close to the second beacon 28.

Therefore, in FIG. 5A, the mobile device 7 is in the first intermediate condition.

In the operative step described above, the integrated logic 14 generates a second monitoring signal $S_{m1}$, indicative of the first intermediate condition of the mobile device 7; based on the second monitoring signal $S_{m1}$, the integrated logic 14 generates, through the app, a second signaling notification, for example a text notification showing the phrase "baby on board" for example on the screen of the mobile device 7. Furthermore, in the operative step of FIG. 5A, the integrated logic 14 deactivates the GPS receiver 16, i.e. it does not determine the GPS position of the mobile device 7 at the fourth time instant $t_3'$, since at least one of the aforementioned verifications based on the third and fourth distance $d_1$, $d_1'$ has given a negative outcome. In this way, the first GPS position $P_0'$ determined in the operative step described with reference to FIG. 4 is kept in the memory 15 of the mobile device 7.

FIG. 5B shows a step after the step described with reference to FIG. 5A; in particular, in the step of FIG. 5B, the same operations described with reference to FIG. 5A are repeated at moments of time after those indicated with reference to FIG. 5A.

In greater detail, at a fifth time instant $t_4'$, after the fourth time instant $t_3'$, the first and the second beacon 11, 28 respectively emit the first and the second signal $S_1$, $S_2$. The first and the second signal $S_1$, $S_2$ thus emitted are received by the receiver 13 at a sixth time instant $t_5'$, the latter defined as the sum between the fifth time instant $t_4'$ and a third time interval $\Delta t_{0,3}'$.

The first and the second signal $S_1$, $S_2$ received at the sixth time instant $t_5'$ form a third pair of signals.

Furthermore, similarly to what is discussed with reference to the first and to the second time interval $\Delta t_{0,1}'$, $\Delta t_{0,2}'$, the third time interval $\Delta t_{0,3}'$ represents the propagation time of the first and of the second signal $S_1$, $S_2$ respectively from the device 5 and from the second beacon 28 to the receiver 13 in the step of FIG. 5B.

Consequently, the receiver 13 transmits the first and the second signal $S_1$, $S_2$ thus received to the integrated logic 14, so that the latter determines, according to the previously described modalities, a fifth and a sixth distance $d_2$, $d_2'$ between the mobile device 7 and, respectively, the device 5 and the second beacon 28. Thereafter, the integrated logic 14 once again carries out the first and the second verification through the app, in which it compares the fifth and the sixth distance $d_2$, $d_2'$ with the radii $R_{th1}$, $R_{th2}$ of the first and the second signaling region 6, 30 respectively to determine whether the mobile device 7 is in the first and/or the second signaling region 6, 30. In the operative step of FIG. 5B, the integrated logic 14 determines that the fifth and the sixth distance $d_2$, $d_2'$ are greater than the radii $R_{th1}$, $R_{th2}$ (distance condition) respectively and, therefore, that the mobile device 7 is far both from the second beacon 28 and from the device 5.

Therefore, in the operative step described above, the integrated logic 14 generates a third monitoring signal $S_{m2}$ indicative of the distance condition of the mobile device 7; therefore, based on the third monitoring signal $S_{m2}$, the integrated logic 14 generates a third signaling notification, for example a text notification showing the phrase "baby on board" for example on the screen of the mobile device 7. Furthermore, also in this case, the integrated logic 14 deactivates the GPS receiver 16, i.e. it does not acquire the GPS position of the mobile device 7 at the sixth time instant $t_5'$, so that the first GPS position $P_0'$ determined in the operative step described with reference to FIG. 4 is kept in the memory 15 of the mobile device 7.

In further embodiments, the integrated logic 14 carries out a third verification, adapted for determining the veracity of the aforementioned notification of abandonment of the infant (FIG. 5B). In particular, at a seventh time instant $t_6'$, defined as the sum between the sixth time instant $t_5'$ and a verification time interval $\Delta t_{ver}$ (for example, equal to 60 s), the mobile device 7 carries out the same operations described with reference to FIGS. 4 and 5A-5B; in other words, the system 20 is once again operated to determine the distances of the mobile device 7 itself with respect to the device 5 and the second beacon 28 and verify that the aforementioned distances are such that the mobile device 7 is in the first and/or in the second signaling region 6, 30 (therefore, that the mobile device 7 is in the proximity condition or in the first intermediate condition). If the mobile device 7 is in the first and in the second signaling region 6, 30 (proximity condition), the integrated logic 14 determines that the signaling notification generated in the step shown in FIG. 5B was not an indication of an actual abandonment of the infant in the vehicle 3, since, at the seventh time instant $t_6'$, the mobile device 7 is once again close to the child seat 2 and the vehicle 3. Therefore, the integrated logic 14 executes the app so that the aforementioned signaling notification is eliminated; furthermore, given the positive outcome of the aforementioned verifications, the integrated logic 14 executes the app to determine and memorize a second GPS position $P_0''$.

If the mobile device 7 is outside the first and/or the second signaling region 6, 30 (first intermediate condition or distance condition), the integrated logic 14 determines that the previous signaling notification is an indication of an actual abandonment of the infant in the vehicle 3; therefore, such a signaling notification is once again signaled to the user on the mobile device 7 through the app.

The aforementioned verification mechanism makes it possible to reduce the number of false signaling notification; for example, the present method can advantageously be used in situations of momentarily going away from the vehicle 3 and from the child seat 2.

Figure 6A:
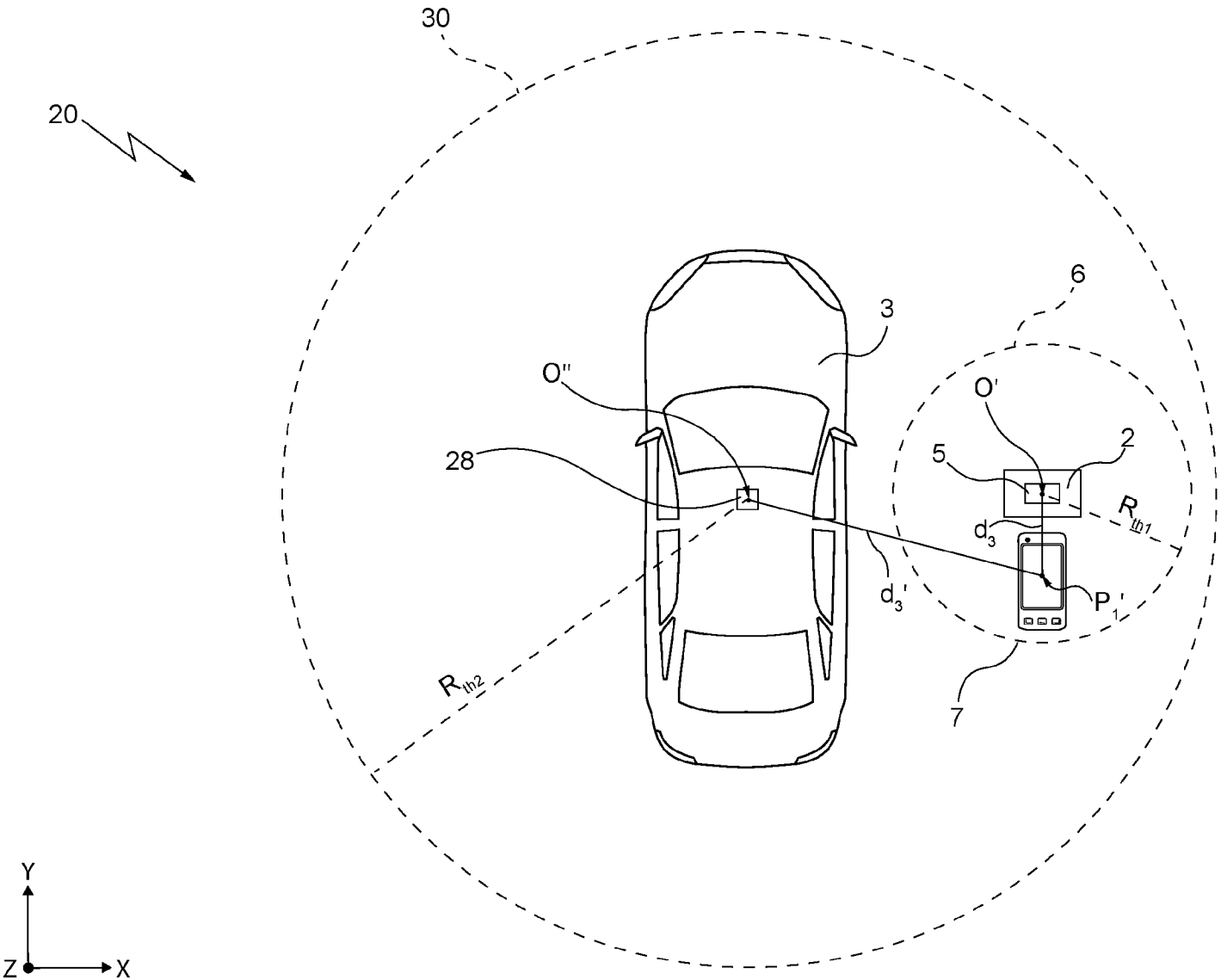
FIGS. 6A-6C schematically show views from above of the monitoring and signaling system of FIG. 4 in a second operative mode.
Figure 6B:
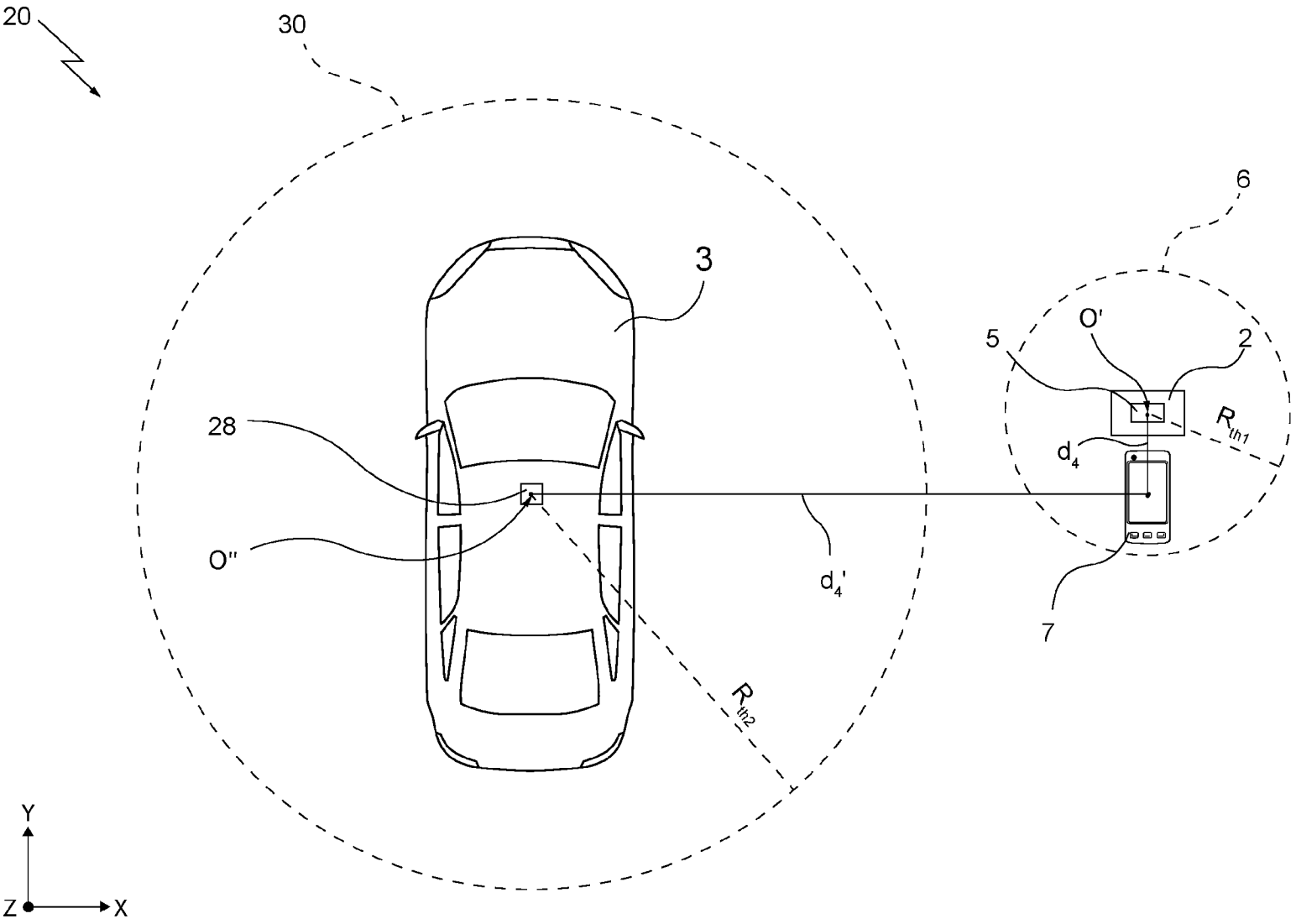
Figure 6C:
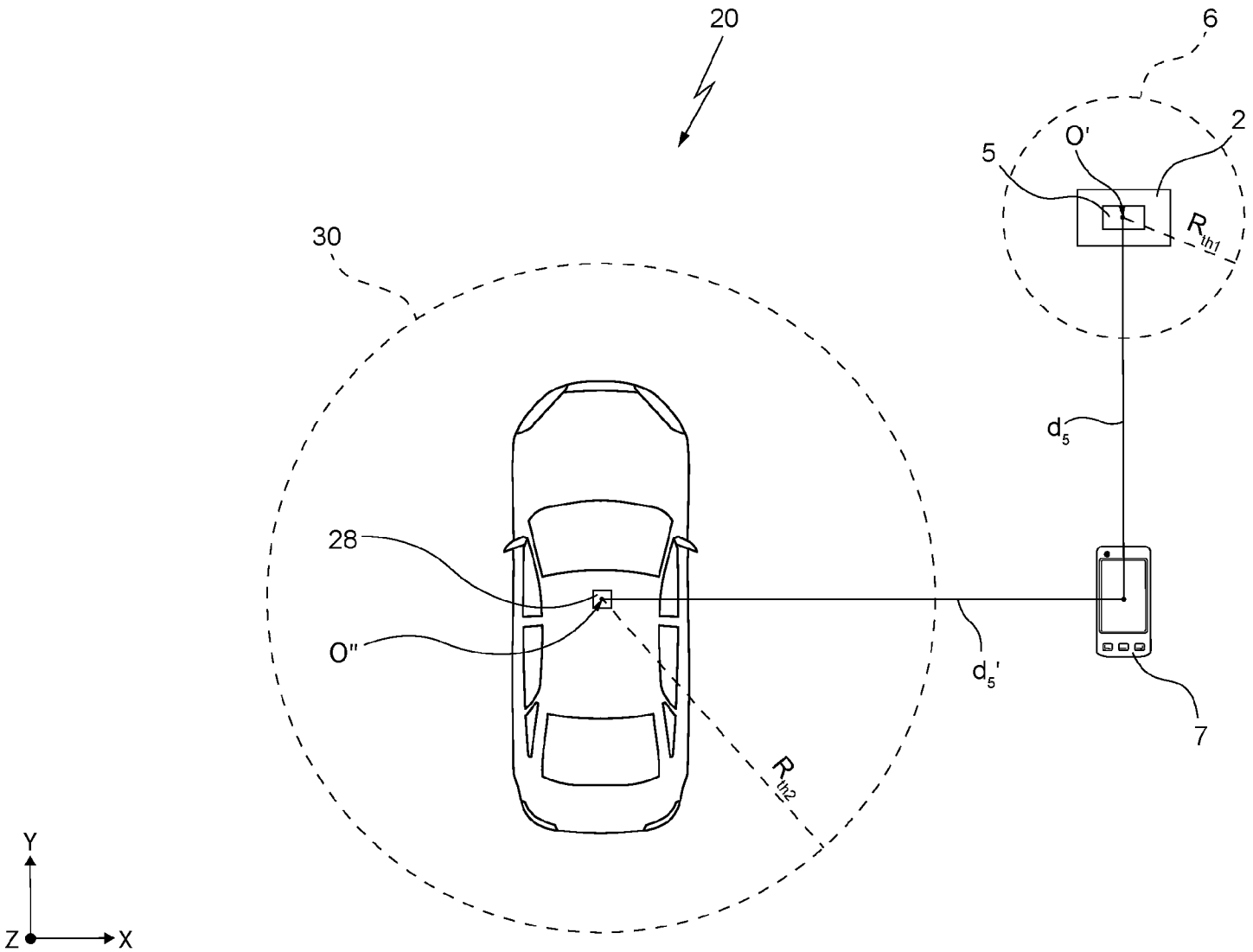

FIGS. 6A-6C show successive steps of a second operative mode, alternative to the first operative mode of FIGS. 5A-5B. In detail, FIGS. 6A, 6B show situations in which the user goes away from the vehicle 3 with the child seat 2 (FIG. 6A) to the point of being outside of the second signaling region 30 (FIG. 6B); FIG. 6C shows a situation in which the user has gone away both from the vehicle 3 and from the child seat 2. Furthermore, in the situations shown in FIGS. 6A-6C the infant is still arranged on the child seat 2.

In particular, FIG. 6A, at a third time instant $t_2''$, since the infant is still arranged on the child seat 2 and, therefore, on the device 5, the first beacon 11 once again generates the first signal $S_1$. At the same third time instant $t_2''$, the second beacon 28 once again emits the second signal $S_2$ upon command of the respective integrated logic (not shown).

At a fourth time instant $t_3''$, defined as the sum between the third time instant $t_2''$ and a second time interval $\Delta t_{0,2}''$, the receiver 13 receives the first signal $S_1$ and transmits it to the integrated logic 14; in detail, the integrated logic 14 processes the aforementioned first signal $S_1$ according to the previously described modalities to once again determine the first processed datum, i.e. a third distance $d_3$ of the mobile device 7 with respect to the device 5 at the fourth time instant $t_3''$.

At the same fourth time instant $t_3''$, the receiver 13 receives the second signal $S_2$ and transmits it to the integrated logic 14; in detail, the integrated logic 14 processes the aforementioned second signal $S_2$ according to the previously described modalities with reference to the first signal $S_1$ to once again determine the second processed datum, i.e. a fourth distance $d_3'$ of the mobile device 7 with respect to the second beacon 28 at the fourth time instant $t_3''$.

The first and the second signal $S_1$, $S_2$ received at the fourth time instant $t_3''$ form a fourth pair of signals.

It should be noted that, since the receiver 13 receives both the first and the second signal $S_1$, $S_2$ at the fourth time instant $t_3''$, the second time interval $\Delta t_{0,2}''$ represents the propagation time of the first and of the second signal $S_1$, $S_2$ respectively from the device 5 and from the second beacon 28 to the receiver 13 in the step of FIG. 6A.

Thereafter, the integrated logic 14 carries out a verification through the app, in which it compares the third and the fourth distance $d_3$, $d_3'$ with the radii $R_{th1}$, $R_{th2}$ of the first and the second signaling region 6, 30 respectively to determine whether the mobile device 7 is in the first and/or the second signaling region 6, 30. In the operative step of FIG. 6A, the integrated logic 14 determines that the third and the fourth distance $d_3$, $d_3'$ are less than the radii $R_{th1}$, $R_{th2}$ (proximity condition) respectively and, therefore, that the mobile device 7 is close to the device 5 and the second beacon 28.

Consequently, in light of the aforementioned verifications, the integrated logic 14 activates the GPS receiver 16, which determines a second GPS position $P_1'$ of the mobile device 7 at the fourth time instant $t_3''$; thereafter, the integrated logic 14 receives the aforementioned second GPS position $P_1'$ and memorizes it in the memory 15.

Furthermore, in the operative step described above, the integrated logic 14 executes the app to generate a fourth signaling notification on the mobile device 7, for example showing the phrase "baby on board", to indicate that the mobile device 7 is in the first and in the second signaling region 6, 30.

FIG. 6B shows a step after the step described with reference to FIG. 6A; in particular, in the step of FIG. 6B, the same operations described with reference to FIG. 6A are repeated.

In greater detail, at a fifth time instant $t_4''$, after the fourth time instant $t_3''$, the first and the second beacon 11, 28 respectively emit the first and the second signal $S_1$, $S_2$. The first and the second signal $S_1$, $S_2$, here forming a fifth pair of signals, thus emitted are received by the receiver 13 at a sixth time instant $t_5''$, defined as the sum between the fifth time instant $t_4''$ and a third time interval $\Delta t_{0,3}''$. Consequently, the receiver 13 transmits the first and the second signal $S_1$, $S_2$ to the integrated logic 14, so that the latter once again determines, according to the previously described modalities, the first and the second processed datum, i.e. a fifth and a sixth distance $d_4$, $d_4'$ between the mobile device 7 and, respectively, the device 5 and the second beacon 28.

Furthermore, similarly to what has been discussed with reference to the second time interval $\Delta t_{0,2}''$, the third time interval $\Delta t_{0,3}''$ represents the propagation time of the first and of the second signal $S_1$, $S_2$ respectively from the device 5 and from the second beacon 28 to the receiver 13 in the step of FIG. 6B.

Thereafter, the integrated logic 14 once again carries out the first verification through the app, in which it compares the fifth and the sixth distance $d_4$, $d_4'$ with, respectively, the radii $R_{th1}$, $R_{th2}$ of the first and the second signaling region 6, 30 to determine whether the mobile device 7 is in the first and/or the second signaling region 6, 30. In the operative step of FIG. 6B, the integrated logic 14 determines that the fifth distance $d_4$ is less than the radius $R_{th1}$ and that the sixth distance $d_4'$ is greater than the radius $R_{th2}$, i.e. the mobile device 7 is close to the device 5 and far from the second beacon 28.

Therefore, the mobile device 7 is in the second intermediate condition, i.e. it is outside the second signaling region 30 and inside the first signaling region 6.

Therefore, in the operative step described above, the integrated logic 14 generates a fourth monitoring signal $S_{m3}$ indicative of the second intermediate condition; based on the fourth monitoring signal $S_{m3}$, the integrated logic 14 executes the app to generate a fifth signaling notification, for example a text notification showing the phrase "thank you for using us" and determines that, since the mobile device 7 is close to the child seat 2, but not to the vehicle 3, the signaling can be deactivated and, therefore, it is not necessary to generate further notifications. In other words, the fourth monitoring signal $S_{m3}$ is a signaling inhibiting signal for the mobile device 7.

FIG. 6C shows a step after the step described with reference to FIG. 6B; in particular, in the step of FIG. 6C, the same operations described with reference to FIGS. 6A-6B are repeated.

In greater detail, at a seventh time instant $t_6''$, after the sixth time instant $t_5''$, the first and the second beacon 11, 28 respectively emit the first and the second signal $S_1$, $S_2$. The first and the second signal $S_1$, $S_2$ thus emitted and here forming a sixth pair of signals are received by the receiver 13 at an eighth time instant $t_7''$, defined as the sum between the seventh time instant $t_6''$ and a fourth time interval $\Delta t_{0,4}''$; consequently, the receiver 13 transmits the first and the second signal $S_1$, $S_2$ to the integrated logic 14, so that the latter determines, according to the previously described modalities, a seventh and an eighth distance $d_5$, $d_5'$ between the mobile device 7 and, respectively, the device 5 and the second beacon 28.

Furthermore, similarly to what has been discussed with reference to the third time interval $\Delta t_{0,3}''$, the fourth time interval $\Delta t_{0,4}''$ represents the propagation time of the first and the second signal $S_1$, $S_2$ respectively from the device 5 and from the second beacon 28 to the receiver 13 in the step of FIG. 6C.

Thereafter, the integrated logic 14 carries out a verification through the app, in which it compares the seventh and eighth distance $d_5$, $d_5'$ with the radii $R_{th1}$, $R_{th2}$ of the first and of the second signaling region 6, 30 respectively to determine whether the mobile device 7 is in the first and/or in the second signaling region 6, 30. In the operative step of FIG. 6C, the integrated logic 14 determines that the seventh and the eighth distance $d_5$, $d_5'$ are greater than the radii $R_{th1}$, $R_{th2}$ (distance condition) respectively and, therefore, that the mobile device 7 is far both from the device 5 and from the second beacon 28.

In this case, the integrated logic 14 generates a fifth monitoring signal $S_{m4}$ indicative of the distance condition of the mobile device 7; based on the aforementioned fifth signal $S_{m4}$, the integrated logic 14 once again determines that, since the previous verification has not given a positive outcome, the signaling continues to be interrupted. Therefore, the fifth monitoring signal $S_{m4}$ is also a signaling inhibiting signal for the mobile device 7.

Figure 7:
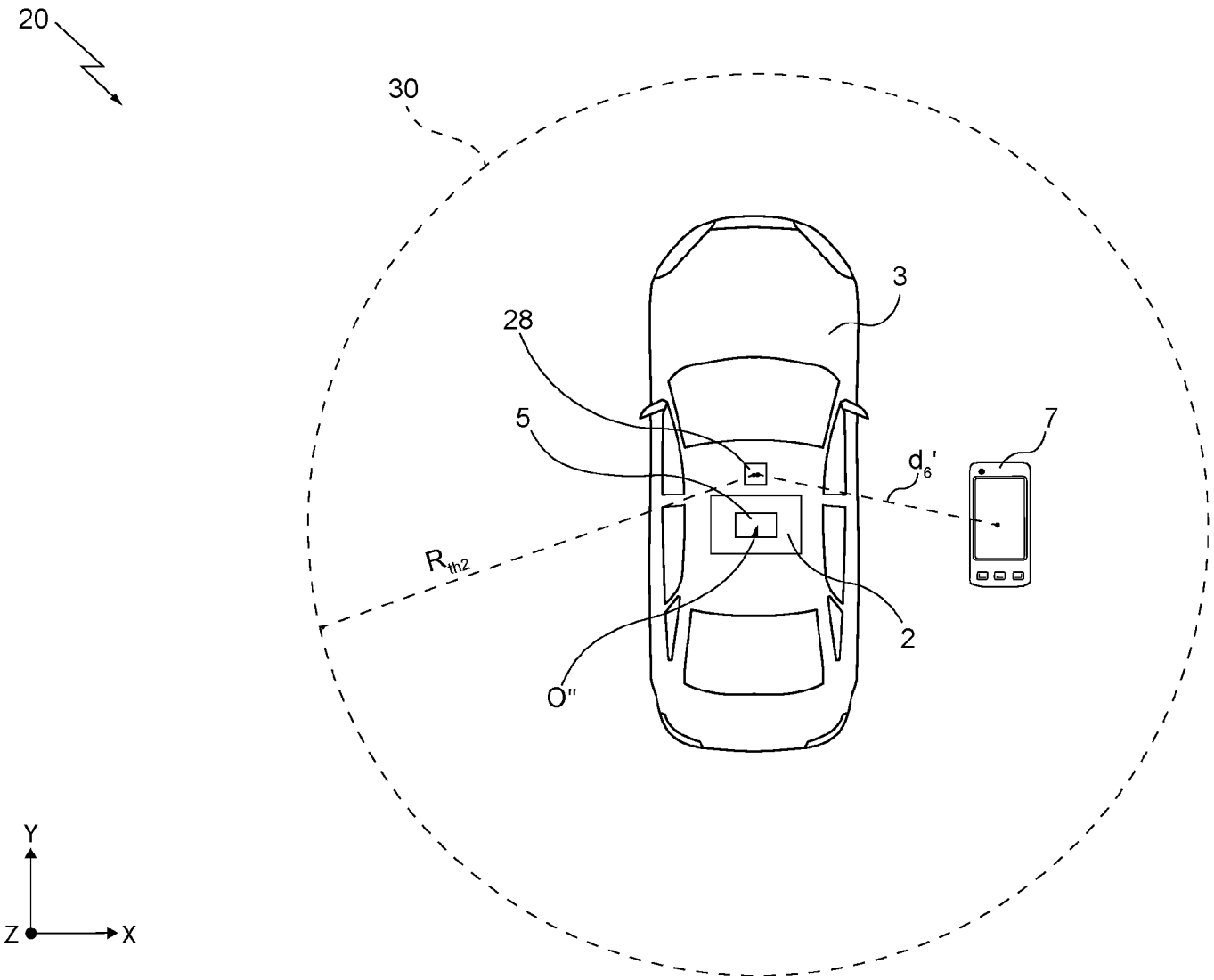
FIG. 7 schematically shows a view from above of the monitoring and signaling system in a third operative mode.

FIG. 7 shows a third operative mode, alternative to the first or to the second operative mode described with reference to FIGS. 5A-5B and 6A-6C respectively. In particular, the third operative mode of FIG. 7 can be carried out both before and after the step described with reference to FIG. 4; hereinafter, it is assumed that the third operative mode of FIG. 7 is carried out after the operative step of FIG. 4.

In particular, at a third time instant $t_2'''$, the infant is not arranged on the child seat 2 and, therefore, on the device 5; consequently, the pressure sensor 10 does not detect the presence of the infant and, therefore, the first beacon 11 is not active. Therefore, the first beacon 11 does not emit the first signal $S_1$. Moreover, at the same third time instant $t_2'''$, the second beacon 28 once again emits the second signal $S_2$ upon command of the respective integrated logic (not shown).

At a fourth time instant $t_3'''$, defined as the sum between the third time instant $t_2'''$ and a second time interval $\Delta t_{0,2}'''$, the receiver 13 receives the second signal $S_2$ and transmits it to the integrated logic 14; in detail, the integrated logic 14 processes the aforementioned second signal $S_2$ according to the previously described modalities to once again determine the second processed datum, i.e. a fourth distance $d_6'$ of the mobile device 7 with respect to the second beacon 28 at the fourth time instant $t_3'''$.

Given the lack of the first signal $S_1$, the integrated logic 14 is not able to verify that the mobile device 7 is in the first signaling region 6.

Therefore, the second time interval $\Delta t_{0,2}'''$ is the propagation time of the second signal $S_2$ from the second beacon 28 to the receiver 13.

However, at the same fourth time instant $t_3'''$, the integrated logic 14 once again carries out the second verification through the app, in which it compares the fourth distance $d_6'$ with the radius $R_{th2}$ of the second signaling region 30 to determine whether the mobile device 7 is in the second signaling region 30. In the step shown in FIG. 6A, the integrated logic 14 determines that the fourth distance $d_6'$ is less than the radius $R_{th2}$ of the second signaling region 30 and, therefore, that the mobile device 7 is close to the second beacon 28.

Consequently, in the operative step described above, the integrated logic 14 does not generate a further monitoring signal and does not execute the app to generate a new signaling notification, since the infant is not on the child seat 2; therefore, the signaling is interrupted.

Figure 13:
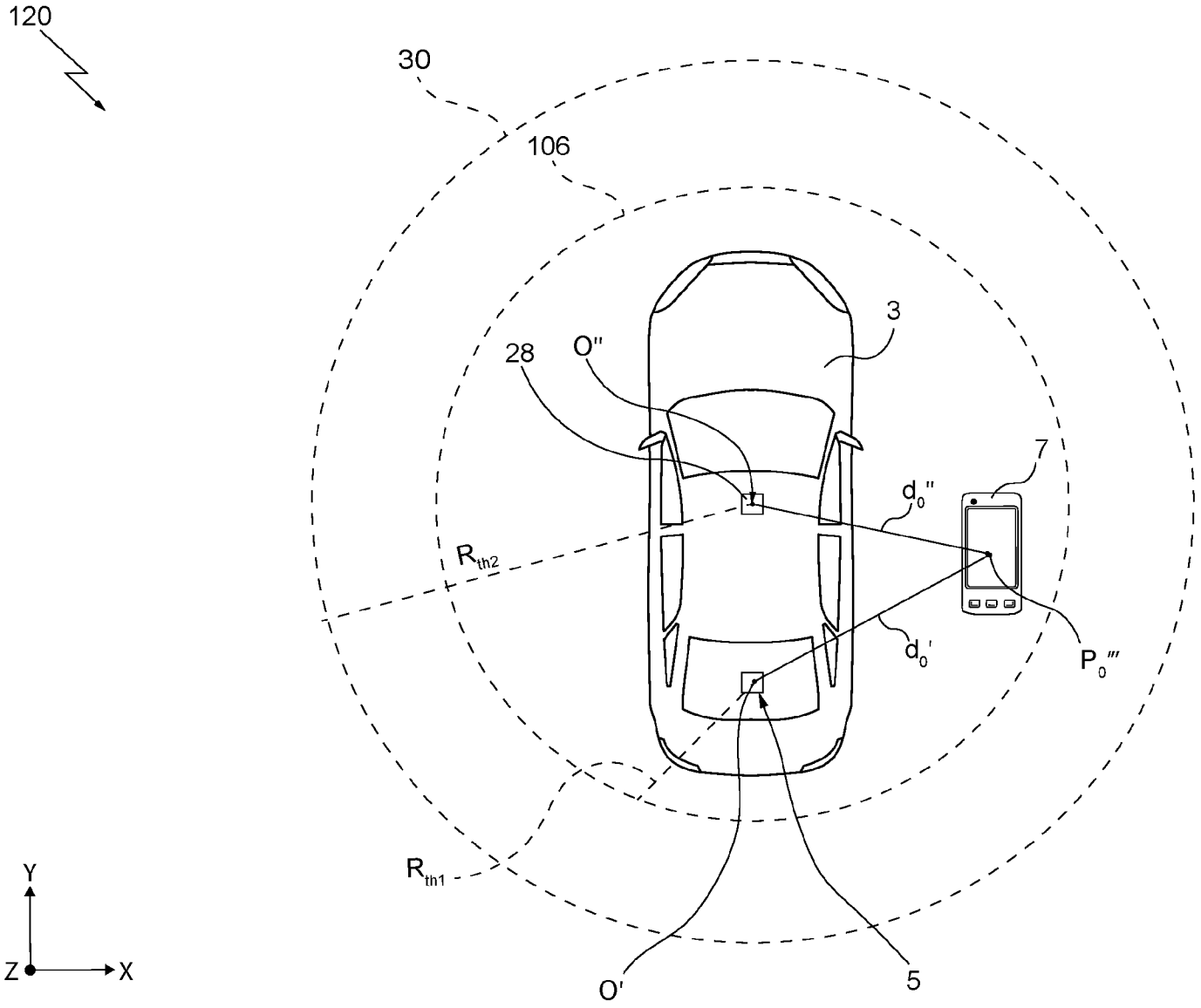
FIG. 13 schematically shows a view from above of the present monitoring and signaling system used for monitoring the presence of a pet inside the vehicle.

FIG. 13 shows a system analogous to the system 20 of FIGS. 4, 5A-5B, 6A-6C and 7; in particular, FIG. 13 shows a system 120 having a structure similar to the system 20 of FIGS. 4, 5A-5B, 6A-6C and 7. Therefore, parts similar to those described with reference to FIGS. 4, 5A-5B, 6A-6C and 7 are indicated with the same reference numerals and are not described any further.

In particular, in the system 120, the device 5, which can be either of the type shown in FIG. 2 or of the type shown in FIG. 8, is arranged on the surface of the bed of the boot of the vehicle 3; in other words, the device 5 is adapted for detecting the presence of a pet inside the vehicle 3.

In use, the system 120 operates in an analogous way to what has been described with reference to FIGS. 4, 5A-5B and 7.

The present method and the present system have different advantages.

In particular, the present system uses the first and the second beacon 11, 28 and the receiver 13 for monitoring and signaling a possible abandonment of an infant in a vehicle. The synergy between the aforementioned elements makes it possible to verify that the user, using the mobile device 7, is distant both from the child seat 2 and from the vehicle 3.

In particular, the verification of proximity to the vehicle 3 through the reception of the second signal $S_2$, emitted by the second beacon 28, makes it possible to determine the distance of the mobile device 7 with respect to the second beacon 28 at any time instant. In this way, the generation of signaling notifications is subject to at least two verifications by the integrated logic 14, which make it possible to verify whether the abandonment of the infant and/or of the pet has actually occurred, consequently limiting the false signaling notifications. As an example, as described with reference to FIGS. 6A-6B, the child seat 2 can accommodate the infant, be distant from the mobile device 7, but not be arranged in the vehicle 3; in this case, the present system and the relative method make it possible to avoid the generation of an otherwise false signaling notification.

Finally, it is clear that modifications and variants can be brought to the system and to the method described and illustrated here without for this reason departing from the scope of protection of the present invention, as defined in the attached claims.

For example, the device 5 can be a sensor different from a pressure sensor, for example an optical sensor.

Figure 9:
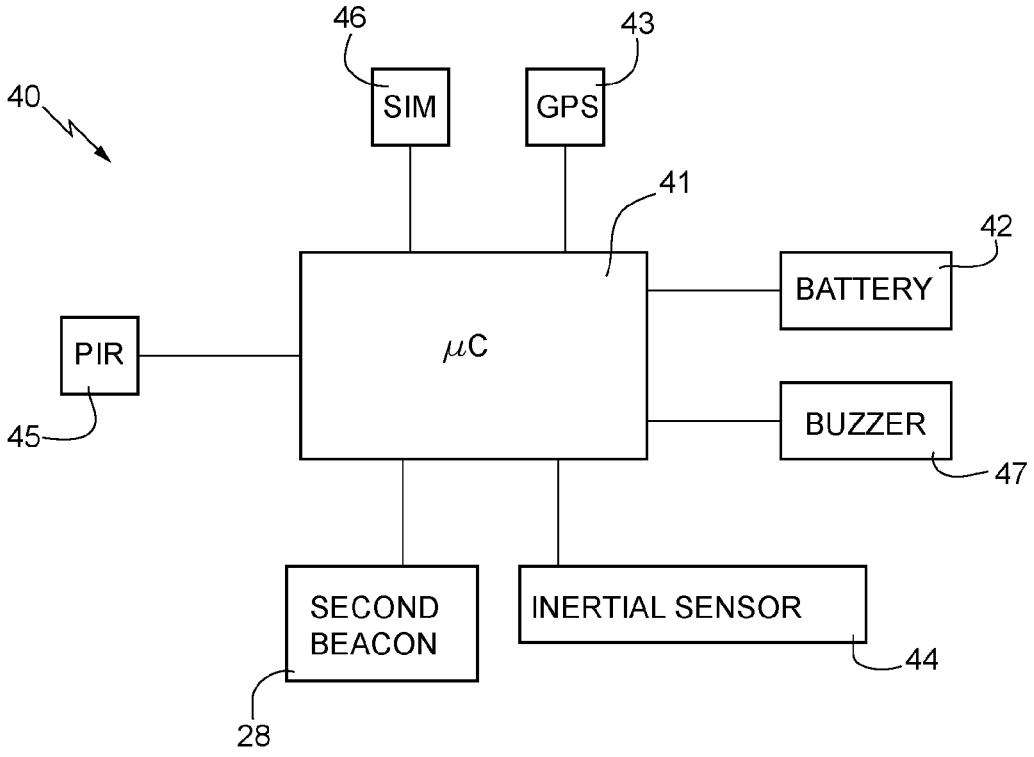
FIG. 9 schematically shows a signaling and detection device configured to be coupled to the vehicle and forming part of the monitoring and signaling system of FIGS. 4-7 according to an alternative embodiment.

Furthermore, in another embodiment, alternative to the one shown in FIGS. 4, 5A-5B, 6A-6C and 7 and shown in FIG. 9, the vehicle 3 is coupled to a signaling device 40, which comprises the second beacon 28. In addition to the second beacon 28, the signaling device 40 comprises: a microcontroller 41, connected to the second beacon 28 is configured to control it through a respective plurality of control signals so that it emits the second signals $S_2$; a battery 42, connected to the microcontroller 41 and configured to power the latter when in use; a position sensor 43, for example a GPS sensor, connected to the microcontroller 41, and configured to generate a plurality of position signals indicative of the geographical position of the vehicle 3, which is received and processed by the microcontroller 41; an inertial sensor 44, for example an accelerometer or a gyroscope, connected to the microcontroller 41, and configured to generate a plurality of inertial signals relative to an amount indicative of a motion state of the vehicle 3, which is received and processed by the microcontroller 41; a PIR ("Passive Infrared") sensor 45 connected to the microcontroller 41, and configured to generate a plurality of signals indicative of an optical detection carried out by the PIR sensor 45, which is received and processed by the microcontroller 41; at least one SIM card 46 connected to the microcontroller 41 and configured to memorize at least one emergency telephone number; and a signaling element 47, for example a buzzer, connected to the microcontroller 41 and configured to generate a signal, for example a vibration or an acoustic signal, as a function of a control signal transmitted by the microcontroller 41 to identify various types of notifications (for example, a correct installation of the set-up for the operation of the system 20 or of the system 120, a correct seating or a correct detection of the infant and/or of the pet, anomalies in the operation of the device 5 and depletion of the battery 42).

It should also be noted that the microcontroller 41 is configured to control the position sensor 43, the inertial sensor 44 and the PIR sensor 45 through corresponding control signals. Furthermore, the microcontroller 41 is configured to communicate through radio frequency signals, using, for example, Bluetooth Low Energy technology, both with the first beacon 11 in a unidirectional manner (i.e. the microcontroller 41 is configured to receive the first signal $S_1$ at any time instant) and with the mobile device 7 in a bi-directional manner. In particular, in this latter case, the microcontroller 41 and the integrated logic 7 are configured to communicate with each other, i.e. the microcontroller 41 is capable of interrogating the integrated logic 14 through the emission of a verification signal (for example, in radio frequency, using, for example, Bluetooth Low Energy technology) to investigate the operative state thereof, as well as of receiving a response signal from the integrated logic 14 indicative of the operative state of the mobile device 7. In other words, the response signal is processed by the microcontroller 41 to determine whether the mobile device 7 is capable of receiving signals from external devices, for example from the device 5 and from the second beacon 28.

In greater detail, the microcontroller 41 interrogates the mobile device 7 sending, at a time instant of a time interval $T_{ctrl}$, verification signals to the mobile device 7.

If the microcontroller 41 receives a response signal at a time instant after the one at which the verification signal was sent and belonging to the time interval $T_{ctrl}$, the microcontroller 41 determines that the mobile device 7 is active (first operating condition); alternatively, if the microcontroller 41 does not receive a response signal within the time interval $T_{ctrl}$, the microcontroller 41 determines that the mobile device 7 is inactive (second operating condition).

In addition, the battery 42 is for example a lithium battery that can be replaced and recharged through a connection port (not shown) to the vehicle 3, like, for example, a USB connection port or cigarette lighter socket of the vehicle 3. Furthermore, the battery 42 is capable of determining whether the aforementioned battery 42 is connected to the vehicle 3 through the connection port or whether the vehicle 3 is turned off and, therefore, the aforementioned battery 42 is not powered by means of the connection port; in particular, if the battery 42 is disconnected from the connection port or does not receive further power signals from the vehicle 3, the power circuit (not shown) of the same battery 42 generates a notification signal, which is transmitted to the microcontroller 41 to warn it. In other words, upon the disconnection of the battery 42 from the vehicle 3, i.e. in a condition of a lack of power, the battery 42 sends a signal to the microcontroller 41.

When in use, the microcontroller 41 is capable of determining the geographical position of the vehicle 3 at a time instant as a function of a position signal of the plurality of position signals transmitted by the position sensor 43; in particular, each position signal is processed by the microcontroller 41 to determine the geographical position of the vehicle 3 at a given time instant.

Similarly, when in use, the microcontroller 41 is capable of determining the motion state of the vehicle 3 at a time instant as a function of a corresponding inertial signal of the plurality of inertial signals transmitted by the inertial sensor 44; in particular, as stated briefly earlier, the inertial sensor 44 allows to detect a magnitude relative to the motion of the vehicle 3 (for example, an acceleration in the case of an accelerometer or an orientation in a triaxial XYZ reference system in the case of a gyroscope). Furthermore, each inertial signal is processed by the microcontroller 41 to determine the motion state of the vehicle 3 at a given time instant.

Furthermore, the PIR sensor 45 makes it possible, in use, to optically detect the presence, for example, of a driver of the vehicle 3 at a time instant and to generate a signal of the plurality of signals indicative of the optical detection carried out by the PIR sensor 45; in particular, such a signal is transmitted to the microcontroller 41, which processes it to determine whether the driver is in the vehicle 3.

In addition, when in use, the microcontroller 41 is configured to send telematic signals (for example, SMS) to the at least one emergency telephone number, memorized in the at least one SIM card 46, if there are connection problems between the mobile device 7 and the device for a vehicle 40 and the first beacon 11 is active (i.e. the microcontroller 41 determines, receiving the first signals $S_1$, that the infant or the pet are in the vehicle 3).

In particular, if the mobile device 7 is temporarily inactive (for example, it is in an area at a greater distance than the second reference distance $R_{th2}$, or in an area with poor coverage or the battery of the mobile device 7 has run out) and, therefore, it cannot receive the first and the second signal $S_1$, $S_2$ generated respectively by the device 5 and by the device 40, the integrated logic 14 is unable to generate any signal to warn the user of the abandonment of the infant or of the pet in the vehicle 3; in addition, the integrated logic 14 is unable to respond to a possible signal coming from the microcontroller 41, which investigates whether the mobile device 7 is reachable and operative. Consequently, the microcontroller 41, not receiving a signal from the mobile device 7 in the time interval $T_{crtl}$, determines that the mobile device 7 is not in the conditions to receive the first and the second signal $S_1$, $S_2$.

In addition to such information, the microcontroller 41 verifies the geographical position of the vehicle 3; in particular, the microcontroller 41 interrogates the position sensor 43, which, in response to the interrogation of the microcontroller 41, detects the geographical position of the vehicle 3 and generates a corresponding position signal and transmits it to the microcontroller 41. The interrogation by the microcontroller 41 and the consequent reception of the position signals is carried out at a predetermined time interval, indicated hereinafter as sample time interval $T_s$: in particular, if the position signals sampled at any time instant of the sample time interval $T_s$ are indicative of the fact that the vehicle 3 is in the same geographical position (i.e. the vehicle 3 is in a first position condition, where the position signals are indicative, except for an error, of the same geographical position), the microcontroller 41 determines that the vehicle 3 is stationary in a geographical position; alternatively, if, starting from a reference time instant $t_{rif}$ of the sample time interval $T_s$, the position signals are indicative of the fact that the vehicle 3 has moved (i.e. the vehicle 3 is in a second position condition, where the position signals, starting from the reference time instant $t_{rif}$, are indicative of one or more different geographical positions), the microcontroller 41 determines that the vehicle 3 has moved.

In addition to the aforementioned information, the microcontroller 41 verifies the motion state of the vehicle 3; in particular, the microcontroller 41 interrogates the inertial sensor 44, which, in response to the interrogation of the microcontroller 41, detects the motion state of the vehicle 3 and generates a corresponding inertial signal and transits it to the microcontroller 41. The interrogation by the microcontroller 41 and the consequent reception of the inertial signals is carried out in a predetermined time interval, which is assumed to be equal to the sample time interval $T_s$(i.e. the microcontroller 41 verifies, in the same time interval, both the geographical position and the motion state): in particular, if the inertial signals sampled at any time instant of the sample time interval $T_s$ are indicative of the fact that the vehicle 3 is not in motion (i.e. the vehicle 3 is in a first motion condition, where the inertial signals are indicative, except for an error, of zero acceleration and speed), the microcontroller 41 determines that the vehicle 3 is not in motion; alternatively, if, starting from a further reference time instant $t_{rif}'$ of the sample time interval $T_s$, the inertial signals are indicative of the fact that the vehicle 3 is in motion (i.e. the vehicle 3 is in a second motion condition, where the inertial signals, starting from the further reference time instant $t_{rif}'$, are indicative of non-zero acceleration and/or speed), the microcontroller 41 determines that the vehicle 3 has moved, i.e. it is in motion.

In addition to the aforementioned information, the microcontroller 41 also interrogates the PIR sensor 45, which detects whether the driver is present on the vehicle 3 through optical detection; consequently, the PIR sensor 45 generates a signal indicative of the optical detection carried out and transmits it to the microcontroller 41, which processes it to determine whether the driver is in the vehicle 3 (i.e. whether the PIR sensor 45 detects a first occupation condition) or whether the driver is outside of the vehicle 3 (i.e. whether the PIR sensor 45 detects a second occupation condition). Also in this case, the interrogation by the microcontroller 41 and the consequent reception of the signals indicative of the optical detection is carried out in a predetermined time interval, which is assumed to be equal to the sample time interval $T_s$(i.e. the microcontroller 41 also verifies, in the same time interval, the occupation state of the vehicle 3): in particular, if the signals indicative of the optical detection sampled at any time instant of the sample time interval $T_s$ are indicative of the fact that the driver is outside of the vehicle 3 (i.e. the PIR sensor 45 detects the second occupation condition), the microcontroller 41 determines that the vehicle 3 is unoccupied; alternatively, if, starting from another reference time instant $t_{rif}''$ of the sample time interval $T_s$, the signals indicative of the optical detection are indicative of the fact that the driver is not in the vehicle 3 (i.e. the PIR sensor 45 detects, starting from the other reference time instant $t_{rif}''$, the first occupation condition), the microcontroller 41 determines that the vehicle 3 is occupied.

In addition to the aforementioned information, the microcontroller 41 verifies the state of the battery 42 through the reception of the notification signal, which, as stated earlier, is indicative of the condition of a lack of power. Alternatively, the microcontroller 41 can verify the state of the battery 42 by sending a power verification signal at a time instant of a predetermined time interval, for example the sample time interval $T_s$; in this case, if the battery 42 responds at a subsequent time instant $t_{rif}'''$ belonging to the sample time interval $T_s$, the aforementioned battery 42 will generate a power response signal or, alternatively, the aforementioned signal indicative of the condition of a lack of power. Differently, if the aforementioned battery 42 does not respond to the aforementioned power verification signal at the aforementioned sample time interval $T_s$, the microcontroller 42 determines that the battery 42 is depleted, i.e. it is in a depletion condition.

If, together with the fact that the mobile device 7 is at a greater distance than the second reference distance $R_{th2}$, the microcontroller 41 detects that the vehicle 3 is stationary (i.e. it is in the first position condition and/or in the first motion condition) in the sample time interval $T_s$, the driver is not in the vehicle 3 (i.e. it is in the second occupation condition) and/or the battery 42 is disconnected from the vehicle 3 or is depleted (i.e. is alternatively in the condition of a lack of power or in the depletion condition), the aforementioned microcontroller 41 autonomously activates an emergency service, i.e. it generates a signaling notification (for example, an SMS or a pre-recorded voice message, which are supplied together with the GPS position, communicated by the position sensor 43, to the microcontroller 41) and transmits it to the at least one emergency telephone number memorized in the at least one SIM 46. In other words, the microcontroller 41 automatically activates one or more signals to the at least one emergency telephone number as a function of one or more signals indicative of the geographical position, of the motion state, of the occupation state and/or of the connection state of the device for a vehicle 40 to the vehicle 3 to notify other users, in order to notify them of the abandonment of the infant or of the pet in the vehicle 3.

In addition, the device 5 can be made according to further embodiments, described hereinafter with reference to FIGS. 10A-10B, 11A-11B and 12A-12B.

Figure 10B:
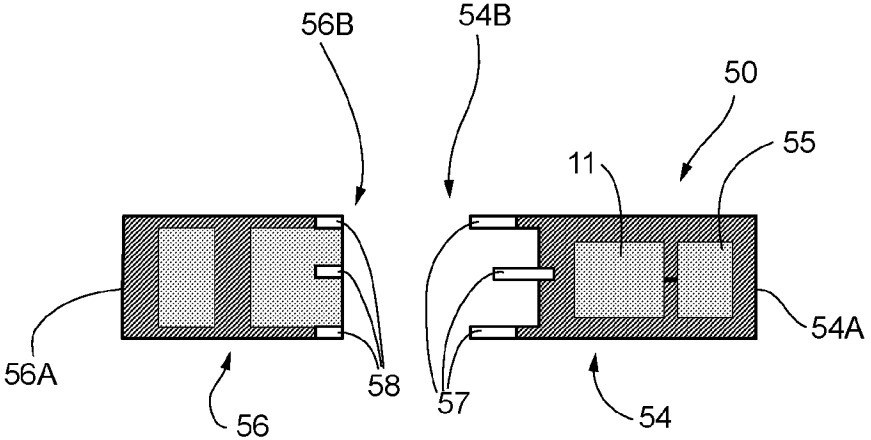
FIGS. 10A and 10B schematically show a signaling and detection device forming part of the monitoring and signaling system of FIGS. 4-7 according to an alternative embodiment with respect to the embodiment of FIG. 2.
Figure 10A:
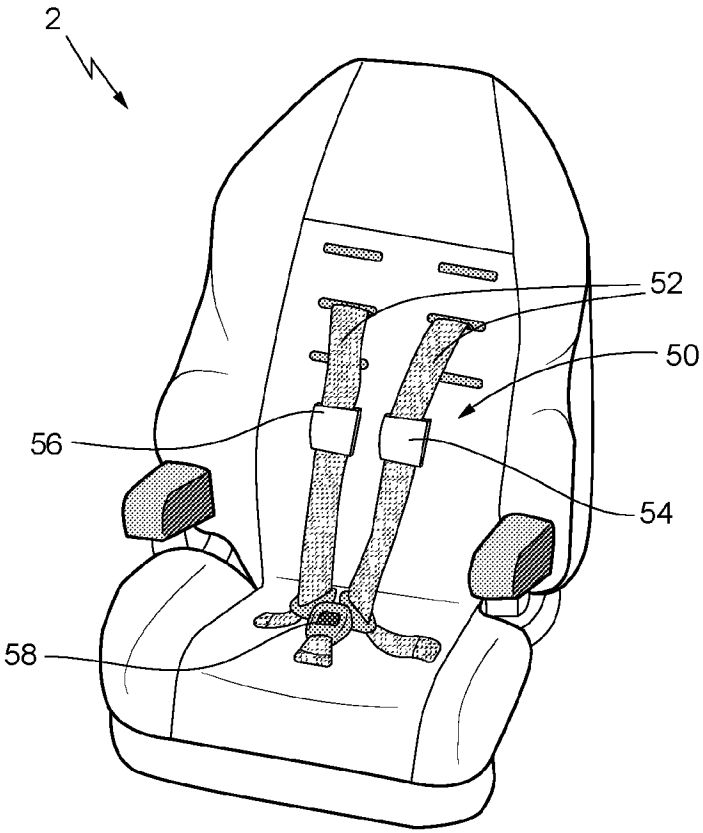

FIGS. 10A and 10B show another embodiment of the device 5, alternative to the embodiments of FIGS. 2 and 8. In particular, FIGS. 10A and 10B show a device 50 analogous to the device 5 of FIGS. 2 and 8; therefore, parts similar to those of FIGS. 2 and 8 are indicated in FIGS. 10A and 10B with the same reference numerals and will not be described any further hereinafter.

In detail, the device 50 here is in the form of a clip and is arranged on safety belts 52 of the child seat 2, so that, when the infant is arranged on the child seat 2, the device 50 operates as further closure element, besides the closure clip 58 of the child seat 2, which makes it possible to arrange the safety belts 52 so that they securely fix the infant to the child seat 2. The device 50 comprises a first and a second portion 54, 56 shaped in a matching manner and configured to physically and electrically couple with each other when the infant is arranged on the child seat 2. In detail, as shown in FIG. 10B, the first portion 54 comprises a main body 54A, comprising the first beacon 11 and a battery 55 (for example, of the replaceable and/or rechargeable type through solar cells), able to be electrically connected to the first beacon 11 when the first and the second portion 54, 56 are connected to one another (i.e. the safety belts 52 fix the infant to the child seat 2) and configured to power it when it is connected to the same first beacon 11; and an end 54B, adapted for coupling to a corresponding end 56B of the second portion 56. Furthermore, the second portion 56 comprises a body 56A, physically coupled to the end 56B and adapted for allowing the complete closure of the device 50. Furthermore, the ends 54B, 56B of the first and the second portion 54, 56 comprise respective electric contacts 57, 58, matching one another, connected through respective conductive paths (not shown) to the battery 55 and to the first beacon 11 and configured, in use, to establish an electric connection between the first and the second portion 54, 56 so that the battery 55 is connected to the first beacon 11; in other words, the first and the second portion 54, 56, when coupled, allow the electric connection between the battery 55 and the first beacon 11, which is thus operative according to the previously described modalities with reference to FIGS. 2 and 8, as well as to FIGS. 4, 5A-5B, 6A-6C and 7.

In use, when the first and the second portion 54, 56 are disconnected from one another, the first beacon 11 is not powered by the battery 55 and, therefore, does not emit any first signal $S_1$; differently, when the first and the second portion 54, 56 are connected to one another (i.e. the electric contacts 57, 58 are in contact with one another and, therefore, are electrically connected), the battery 55 is electrically connected to the first beacon 11, which is thus powered by the battery 55 and can emit the first signals $S_1$ according to the previously described modalities with reference to FIGS. 2 and 8, as well as to FIGS. 4, 5A-5B, 6A-6C and 7.

When the device 50 is used alternatively to the device 5 of FIGS. 2 and 8 in the system 20, the latter operates according to the modalities described with reference to FIGS. 4, 5A-5B, 6A-6C and 7.

In further embodiments, now shown here, the device 50 can be integrated in the closure clip 58, i.e. the coupling of the portions 54, 56 also determines the fixing of the infant to the child seat 2.

Figure 11B:
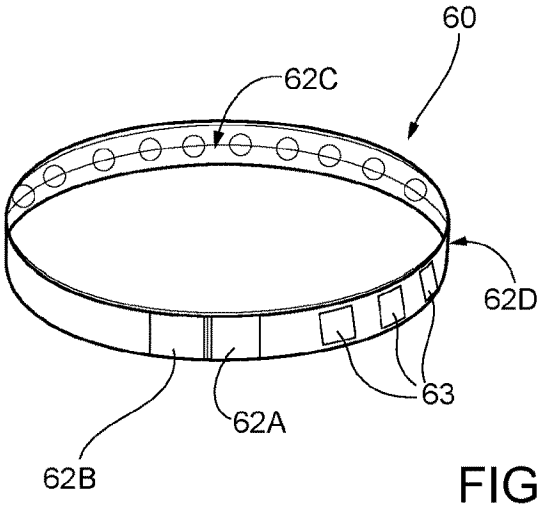
FIGS. 11A and 11B schematically show a signaling and detection device forming part of the monitoring and signaling system of FIGS. 4-7 according to an alternative embodiment with respect to the embodiment of FIG. 10 in a first and a second position.
Figure 11A:
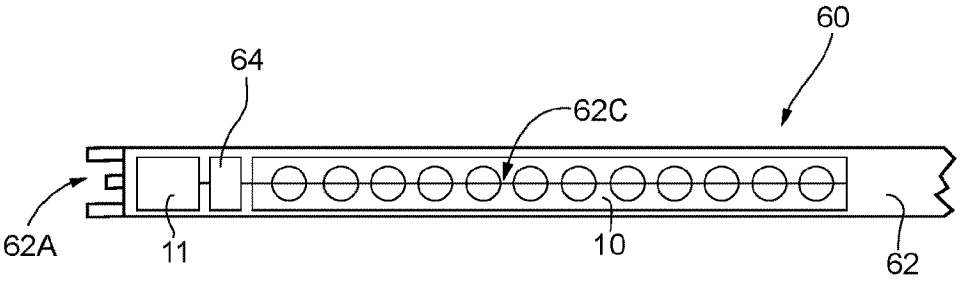

FIGS. 11A and 11B show a device similar to the device 5 of FIG. 2. In particular, FIGS. 11A and 11B show a device 60 analogous to the device 5 of FIGS. 2 and 8; therefore, parts similar to those of FIGS. 2 and 8 are indicated in FIGS. 11A and 11B with the same reference numerals and will not be described any further hereinafter.

In detail, the device 60 comprises a collar 62, shown partially and in open configuration in FIG. 11A and in closed configuration in FIG. 11B, having a first closure element 62A adapted to physically couple to a second closure element 62B (shown only in FIG. 11B) to allow the closure of the collar 62 and the operativity of the device 60 itself. In greater detail, the pressure sensor 10 and the first beacon 11, the latter connected to the pressure sensor 10, are electrically coupled to a battery 64, adapted for powering them in use, and are arranged on an inner portion 62C of the collar 62, facing towards the neck of the pet wearing the aforementioned collar 62; in addition, solar cells 63, coupled to the battery 64, configured to charge the battery 64 and thus keep the operativity of the pressure sensor 10 and of the first beacon 11, are arranged on an outer portion 62D of the collar 62, i.e. towards the outside environment to effectively receive the solar rays and convert the corresponding solar energy into electric energy to power the detection unit 10 and the first beacon 11.

The aforementioned embodiment can advantageously be used in the case in which it is wished to detect the presence in the vehicle 3 of a pet, the latter wearing the collar 62.

In use, the device 60 operates in an analogous way to what has been discussed with reference to FIGS. 2 and 8; furthermore, when the device 60 is used alternatively to the device 5 in the system 120, the latter operates according to the modalities described with reference to FIG. 13, as well as, therefore, to FIGS. 4, 5A-5B, 6A-6C and 7.

Figure 12B:
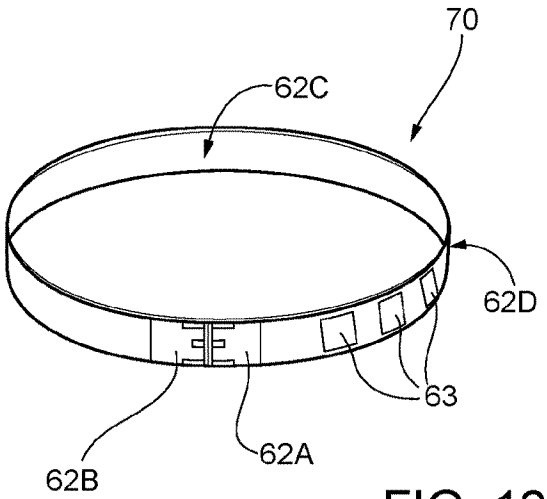
FIGS. 12A and 12B schematically show a signaling and detection device forming part of the monitoring and signaling system of FIGS. 4-7 according to an alternative embodiment with respect to the embodiment of FIGS. 10 and 11A-11B in a first and a second position.
Figure 12A:
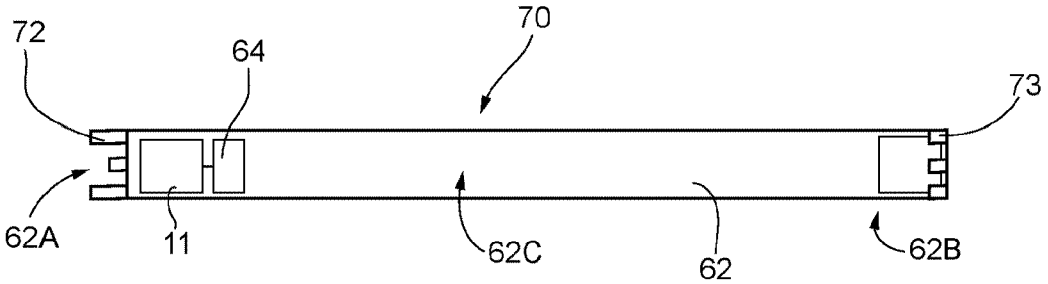

FIGS. 12A and 12B show a device similar to the device 60 of FIGS. 11A and 11B. In particular, FIGS. 12A and 12B show a device 70 analogous to the device 60 of FIGS. 11A and 11B; therefore, parts similar to those of FIGS. 11A and 11B are indicated in FIGS. 12A and 12B with the same reference numerals and will not be described any further hereinafter.

In detail, the device 70 comprises only the battery 64, the first beacon 11 and the solar cells 63, which are arranged as described earlier with reference to FIGS. 11A and 11B; in other words, in an analogous way to what has been discussed with reference to FIGS. 10A, 10B, the device 70 lacks the detection unit 10. In addition, at the closure elements 62A, 62B of the collar 62, the device 70 comprises respective electric contacts 72, 73, which are shaped to be electrically coupled with each other and are electrically connected to the battery 64 and to the first beacon 11 through conductive paths (not shown) extending on the inner portion 62C of the collar 62; in particular, when the first and the second closure element 62A, 62B are physically coupled with one another (i.e. the collar 62 is in closed configuration), the electric contacts 72, 73 are also coupled with one another and, in an analogous way to what has been described with reference to FIGS. 10A, 10B, the electric contact between the electric contacts 72, 73 allow to electrically connect the battery 64 to the first beacon 11, which is thus operative. Therefore, similarly to what has been discussed with reference to FIG. 10, the first beacon 11 is active thanks to the electric contact provided by the ends 70A, 70B of the collar 62. The present embodiment can also advantageously be used to detect the presence of pets, wearing the device 70, inside the vehicle 3.

In use, the device 70 operates in an analogous way to what has been discussed with reference to FIGS. 10A and 10B; furthermore, when the device 70 is used alternatively to the device 5 in the system 120, the latter operates according to the ways described with reference to FIG. 13, as well as, therefore, to FIGS. 4, 5A-5B, 6A-6C and 7.

In further embodiments, not shown here, the collar 62 has a closure clip independent from the closure elements 62A, 62B, i.e. the latter can be coupled independently from the coupling of the portions of the closure clip; in other words, the collar 62 can be closed on the neck of the pet without the electric contacts 72, 73 being connected and, therefore, allowing the powering of the first beacon 11.

In addition, the system 20, 120 can comprise more than one device 5, 50, 60, 70; in other words, in a same system 20, 120, there may be, for example, a device 5 of the type shown in FIG. 2 for the detection of the presence of the infant in the vehicle 3 and a device 5 of the type shown in FIG. 8 for the detection of the presence of the pet for example in the boot of the aforementioned vehicle 3 simultaneously. Furthermore, if the first and the second signal $S_1$, $S_2$ are dephased from one another, the determining of the pair of signals that the receiver 13 acquires and that is processed by the integrated logic 14 according to the previously described modalities to determine the condition of the system 20 can take place, for example, by selecting the second signal $S_2$ received at a first time instant to and the first signal $S_1$ received at the immediately preceding time instant $t_{n-1}$.

Furthermore, with reference to the step shown in FIG. 6B, if the integrated logic 14 detects that the mobile device 7 is in the proximity condition at a time instant after the sixth time instant $t_5''$ (i.e. that the mobile device 7 is once again in the condition shown in FIG. 6A), the corresponding monitoring signal, generated by the integrated logic 14, would be indicative of the proximity condition and, therefore, the integrated logic 14 would once again carry out the aforementioned monitoring and signaling operations. In other words, the corresponding monitoring signal would be a signaling enabling signal for the mobile device 7.

The invention claimed is:

1. Monitoring and signaling system (20; 120) comprising at least one safety device for vehicles (5, 10; 50; 60; 70) selected among:

a detection device for infants (10) which can be coupled to a seat (2) for infants, said detection device being configured to generate a first output signal indicative of the presence of an infant on the seat;

a detection device for animals (10) which can be coupled to an item for a boot or for a pet carrier (5) and configured to generate a second output signal indicative of the presence, in the boot of a vehicle (3) or in the pet carrier, of a pet;

a first actuation device (50; 70) coupled to safety belts (52) of the seat (2) or to a collar (62) and configured to generate a third signal indicative of a closure state of the safety straps or of the collar; and a second actuation device (60) coupled to the collar (62) and configured to generate a fourth output signal indicative of the presence of a pet that wears the collar (62), said monitoring and signaling system also comprising:

a first signaling device (11) coupled to the at least one safety device for vehicles and configured to emit first signals ($S_1$) in sequence when the first output signal indicates the presence of the infant on the seat or when the second output signal indicates the presence in the boot or in the pet carrier of the pet or when the third output signal indicates the closure state of the safety straps of the seat or of the collar or when the fourth output signal indicates the presence of the pet wearing the collar; and a second signaling device (28), couplable to the vehicle (3) and configured to emit second signals ($S_2$) in sequence when coupled to the vehicle;

said system further comprising a mobile device (7) comprising:

processing means (13, 14) configured to receive pairs of signals, each formed by a respective first signal and by a corresponding second signal, and to determine, for each pair, a corresponding value of a first distance (do', $d_1$, $d_2$, $d_3$, $d_4$, $d_5$) and a corresponding value of a second distance ($d_0''$, $d_1'$, $d_2'$, $d_3'$, $d_4'$, $d_5'$), starting from the first and the second signal of the pair respectively, said first distance being present between the mobile device and the first signaling device, said second distance being present between the mobile device and the second signaling device;

comparison means (14) configured to compare the values of the first and second distances with a first and a second reference distance ($R_{th1}$, $R_{th2}$), respectively;

detection means (14) configured to detect, for each received pair of signals, whether the system (20) operates alternately in:

a proximity condition, wherein the values of the first and second distances are less than the first and second reference distances, respectively; or a distance condition, wherein the values of the first and second distances are greater than the first and the second reference distances, respectively; or a first intermediate condition, wherein the first distance is greater than the first reference distance, and the second distance is less than the second reference distance; or a second intermediate condition, wherein the first distance is less than the first reference distance, and the second distance is greater than the second reference distance;

said system further comprising:

signaling means (14) configured to generate, in the event that the detection means detect the distance condition, different monitoring signals ($S_{m1}$, $S_{m2}$, $S_{m3}$, $S_{m4}$), depending on the fact that said distance condition has been detected after the detection, by said detection means, of the first or the second intermediate condition.

2. System according to claim 1, wherein the mobile device (7) further comprises:

verification means (14) configured to verify, after the detection means (14) have detected, based on a first pair of received signals ($S_1$, $S_2$), said distance condition, if, based on a subsequent second pair ($S_1$, $S_2$) of received signals, the first detection means (14) detect that the system (20; 120) still operates in the distance condition, the second pair being received after starting from the reception of the first pair, a time interval, having a duration at least equal to a predetermined duration, has elapsed;

and wherein said signaling means (14) are further configured so that the generation of the monitoring signal ($S_{m1}$, $S_{m2}$, $S_{m3}$, $S_{m4}$) corresponding to said detection of said distance condition on the basis of the first pair of received signals is subject to the fact that the verification means verify that the detection means have detected, based on the second pair of received signals, that the system still operates in the distance condition.

3. System according to claim 1, wherein the signaling means (14) are further configured to generate, in the event that the detection means (14) detect the distance condition, a monitoring signal ($S_{m1}$, $S_{m2}$, $S_{m3}$, $S_{m4}$), if said distance condition was detected after the detection, by said detection means (14), of the first intermediate condition or of the proximity condition.

4. System according to claim 2, wherein the mobile device (7) further comprises:

a satellite receiver (16), configured to activate to determine a position ($P_0'$, $P_1'$; $P_0''$; $P_0'''$) of the mobile device, when the detection means (14) detect that the system (20; 120) operates in a proximity condition, and to remain inactive when the detection means detect that the system operates in any among the distance condition and the first and the second intermediate condition; and memory means (15) configured to memorize the position determined by the satellite receiver.

5. System according to claim 1, wherein said second reference distance ($R_{th2}$) is greater than said first reference distance ($R_{th1}$).

6. System according to claim 1, wherein said first actuation device (50; 70) comprises:

a power source (55; 64) cuplable to said first signaling device (11) and configured to power said first signaling device when coupled to said first signaling device;

first and second electric contacts (53, 54; 72, 73) that can be coupled to one another and configured to allow the electric connection between said power source and said first signaling device when said first and second electric contacts are coupled to one another, wherein the connection between said power source and said first signaling device by means of the coupling of said first and second electric contacts is indicative of a closure state of the safety straps of said seat (2) or of the collar.

7. System according to claim 1, further comprising a device for a vehicle (40), which includes said second signaling device (28) and furthermore:

a microcontroller (41) coupled to said second signaling device and to said mobile device, said microcontroller being configured to:

transmit verification signals to said mobile device to verify the operativity of said mobile device;

alternately determine:

a first operating condition, wherein said microcontroller receives response signals from said mobile device related to the operativity of the mobile device in a time interval ($T_{ctrl}$); or a second operating condition, wherein said mobile device is inactive in said time interval;

at least one SIM card (46) coupled to said microcontroller and adapted for memorizing at least one emergency number.

8. System according to claim 7, wherein the device for a vehicle (40) further comprises:

a satellite receiver (43), coupled to said microcontroller (41) and configured to determine a geographical position of said vehicle (3), said satellite receiver being configured to generate position signals indicative of said geographical position; and said microcontroller further being configured to:

receive said position signals;

processing said position signals to alternately determine whether the vehicle (3) is in:

a first position condition, wherein the position of the vehicle (3) is unchanged in a first sample time interval ($T_s$); or a second position condition, wherein the position of the vehicle (3) varies from a first time instant ($t_{rif}$) of said first sample time interval.

9. System according to claim 7, wherein said device for a vehicle (40) further comprises:

an inertial detection unit (44), coupled to said microcontroller and configured to detect an amount relative to a movement condition of said vehicle, said inertial detection unit being configured to generate inertial signals as a function of said amount, said microcontroller being further configured to:

receive said inertial signals;

process said inertial signals to alternately determine whether the vehicle (3) is in:

a first motion condition, wherein the amount of the vehicle (3) is zero in a second sample time interval ($T_s$); or a second motion condition, wherein the amount of the vehicle (3) is different from zero starting from a second time instant ($t_{rif}'$) of said second sample time interval.

10. System according to claim 7, wherein said device for a vehicle (40) further comprises:

an optical sensor (45) coupled to the microcontroller (41) and configured to generate optical detection signals indicative of the presence of a driver in the vehicle (3) and to transmit said detection signals to the microcontroller (41), said microcontroller being further configured to:

process said optical detection signal to alternately determine:

a first occupation condition, wherein the optical sensor detects that the driver is outside of the vehicle in a third sample time interval ($T_s$); or a second occupation condition, wherein the optical sensor detects that the driver is in the vehicle starting from a third time instant ($t_{rif}''$) of said third time interval.

11. System according to claim 7, wherein said device for a vehicle (40) further comprises:

a power source for a vehicle (42) coupled to the microcontroller (41) and couplable to the vehicle (3), the power source for a vehicle being configured to generate notification signals in a condition of a lack of power, wherein said power source is decoupled from said vehicle, said microcontroller being further configured to send a power verification signal to verify the power state of said power source for a vehicle, said microcontroller being further configured to alternately determine, in a fourth time interval ($T_s$), a depletion condition when said power source is depleted in said fourth time interval and the condition of a lack of power when said power source transmits the notification signal in a fourth time instant ($t_{rif}'''$) of said fourth time interval.

12. System according to claim 7, wherein said microcontroller (41) is configured to generate a signal to be sent to said at least one emergency number memorized in said at least one SIM card (46) if said microcontroller determines:

the second operating condition; and at least one among the first position condition, the first motion condition, the first occupation condition, the condition of a lack of power and the depletion condition.

13. Monitoring and signaling method comprising the steps of:

generating at least one selected among:

a first output signal indicative of the presence of an infant on a seat (2);

a second output signal indicative of the presence, in a boot of a vehicle (3) or in a pet carrier, of a pet;

a third signal indicative of a closure state of safety belts of the seat (2) or of a collar; and a fourth output signal indicative of the presence of a pet wearing the collar (62), said monitoring and signaling method further comprising the steps of:

emitting first signals ($S_1$) in sequence from the seat when the first output signal indicates the presence of the infant in the seat or from the boot of the vehicle or from the pet carrier, when the second output signal indicates the presence in the boot or in the pet carrier of the pet or from the seat or from the collar when the third output signal indicates the closure state of the safety belts of the seat or of the collar or from the collar when the fourth output signal indicates the presence of the pet wearing the collar; and emitting second signals ($S_2$) in sequence from the vehicle (3);

receiving, through a mobile device (7), pairs of signals each formed by a respective first signal and by a corresponding second signal;

determining, for each pair, a corresponding value of a first distance (do', $d_1$, $d_2$, $d_3$, $d_4$, $d_5$) and a corresponding value of a second distance ($d_0''$, $d_1'$, $d_2'$, $d_3'$, $d_4'$, $d_5'$), from the first and second signal of the pair, respectively, said first distance being present between the mobile device and the seat or the collar or the boot of the vehicle or the pet carrier, said second distance being present between the mobile device and the vehicle;

comparing the values of the first and second distance with a first and a second reference distance ($R_{th1}$, $R_{th2}$), respectively;

detecting, for each received pair of signals, whether the system (20; 120) operates alternately in:

a proximity condition, wherein the values of the first and the second distances are less than the first and the second reference distances, respectively; or a distance condition, wherein the values of the first and the second distances are greater than the first and the second reference distances, respectively; or a first intermediate condition, wherein the first distance is greater than the first reference distance, and the second distance is less than the second reference distance; or a second intermediate condition, wherein the first distance is less than the first reference distance, and the second distance is greater than the second reference distance;

said method further comprising the steps of:

generating, in the event that the distance condition has been detected, different monitoring signals ($S_{m1}$, $S_{m2}$, $S_{m3}$, $S_{m4}$), depending on the fact that said distance condition has been detected after the detection of the first or the second intermediate condition.

14. Method according to claim 13 further comprising the step of:

verifying, after said distance condition has been detected, based on a first pair of received signals ($S_1$, $S_2$), whether, based on a subsequent second pair ($S_1$, $S_2$) of received signals, the system (20) still operates in the distance condition, the second pair being received after a time interval having a duration at least equal to a predetermined duration has elapsed, starting from the reception of the first pair; and wherein the generation of the monitoring signal ($S_{m1}$, $S_{m2}$, $S_{m3}$, $S_{m4}$) corresponding to said detection of said distance condition based on the first pair of received signals is subject to the fact that it has been detected, based on the second pair of received signals, that the system still operates in the distance condition.

15. Method according to claim 13, further comprising the step of generating, in the event of the distance condition having been detected, a same monitoring signal ($S_{m1}$, $S_{m2}$, $S_{m3}$, $S_{m4}$), if said distance condition has been detected after the detection of the first intermediate condition or of the proximity condition.

16. Method according to claim 13, further comprising the steps of:

activating a satellite receiver (16) to determine a position ($P_0'$, $P_1'$; $P_0''$; $P_0'''$) of the mobile device (7), after the detection of the operation in proximity condition of the system (20; 120), and deactivating said satellite receiver after the detection of the operation in any among the distance condition and the first and the second intermediate condition of the system; and memorizing the position determined by the satellite receiver.

17. Method according to claim 13, wherein the step of generating said third signal comprises the step of electrically coupling first and second electric contacts (53, 54; 72, 73).

18. Method according to claim 13, further comprising the steps of:

generating verification signals through a microcontroller (41);

transmitting said verification signals to said mobile device to verify the operativity of said mobile device;

alternately determining:

a first operating condition, wherein said microcontroller receives response signals from said mobile device relative to the operativity of the mobile device in a time interval ($T_{ctrl}$); or a second operating condition, wherein said mobile device is inactive.

19. Method according to claim 18, wherein the device for a vehicle (40) further comprises:

generating position signals through a position sensor (43) indicative of geographical positions of said vehicle (3);

processing said position signals to alternately determine whether the vehicle (3) is in:

a first position condition, wherein the position of the vehicle (3) is unchanged in a first sample time interval ($T_s$); or a second position condition, wherein the position of the vehicle (3) varies from a first time instant ($t_{rif}$) of said first sample time interval.

20. Method according to claim 18 or 19, further comprising the steps of:

generating inertial signals as a function of an amount relative to a movement condition of said vehicle;

processing said inertial signals to alternately determine whether the vehicle (3) is in:

a first motion condition, wherein the amount of the vehicle (3) is zero in a second sample time interval ($T_s$); or a second motion condition, wherein the amount of the vehicle (3) is different from zero starting from a second time instant ($t_{rif}'$) of said second sample time interval.

21. Method according to claim 18, further comprising the steps of:

generating optical detection signals indicative of the presence of a driver in the vehicle (3);

processing said optical detection signals to alternately determine:

a first occupation condition, wherein the optical sensor detects that the driver is outside of the vehicle in a third sample time interval ($T_s$); or a second occupation condition, wherein the optical sensor detects that the driver is in the vehicle starting from a third time instant ($t_{rif}''$) of said third time interval.

22. Method according to claim 18, further comprising the step of generating notification signals in a condition of a lack of power, indicative of a decoupling of a power source to the vehicle, wherein the method further comprises the steps of:

sending a power verification signal to verify the power state of said power source for a vehicle;

alternately determining, in a fourth time interval ($T_s$), a depletion condition when said power source is depleted in said fourth time interval and the condition of a lack of power when said power source transmits the notification signal in a fourth time instant ($t_{rif}'''$) of said fourth time interval.

23. Method according to claim 18, further comprising the step of generating a signal to be sent to at least one emergency number memorized in at least one SIM card (46) if the following are determined:

the second operating condition; and at least one among the first position condition, the first motion condition, the first occupation condition, the condition of a lack of power and the depletion condition.

* * * * *